US011237493B2

(12) United States Patent
Makisumi et al.

(10) Patent No.: US 11,237,493 B2
(45) Date of Patent: Feb. 1, 2022

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Kohei Makisumi, Suntou-gun (JP); Kaname Watariguchi, Yokohama (JP); Masataka Kawahara, Mishima (JP); Tomohito Ishida, Suntou-gun (JP); Michiyo Sekiya, Atami (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/903,525

(22) Filed: Jun. 17, 2020

(65) Prior Publication Data

US 2020/0409278 A1 Dec. 31, 2020

(30) Foreign Application Priority Data

Jun. 25, 2019 (JP) ..... JP2019-117810

(51) Int. Cl.
*G03G 15/00* (2006.01)
*G03G 5/047* (2006.01)
(Continued)

(52) U.S. Cl.
CPC ..... *G03G 5/047* (2013.01); *G03G 15/0409* (2013.01); *G03G 21/1814* (2013.01)

(58) Field of Classification Search
CPC .... G03G 5/0433; G03G 5/0436; G03G 5/047; G03G 15/0409; G03G 21/1814
See application file for complete search history.

(56) References Cited

U.S. PATENT DOCUMENTS 5,455,135 A 10/1995 Maruyama et al.
5,693,443 A 12/1997 Nakamura et al.
(Continued)

FOREIGN PATENT DOCUMENTS

JP H04-130433 5/1992
JP H08-137115 5/1996
(Continued)

OTHER PUBLICATIONS

U.S. Appl. No. 16/891,525, Shuhei Iwasaki, filed Jun. 3, 2020.
(Continued)

*Primary Examiner* — Hoang X Ngo
(74) *Attorney, Agent, or Firm* — Venable LLP

(57) ABSTRACT

Provided is an electrophotographic photosensitive member which enables a reduction in unevenness in distribution of the post-exposure potential of the photosensitive member and a reduction in unevenness in life of the photosensitive member in the axial direction. An electrophotographic photosensitive member, including a cylindrical support, a charge generating layer, and a charge transport layer in this order, wherein when a region from a central position of an image formation region of the electrophotographic photosensitive member to an end position of the image formation region in the axial direction of the cylindrical support is equally divided into five regions, average film thicknesses of the charge generating layer in the five regions satisfy specific relations in a film thickness of the charge generating layer and average film thicknesses of the charge transport layer in the five regions satisfy specific relations in a film thickness of the charge transport layer.

20 Claims, 9 Drawing Sheets

(51) Int. Cl.
*G03G 21/18* (2006.01)
*G03G 15/04* (2006.01)

(56) References Cited

U.S. PATENT DOCUMENTS

| | | | |
|---|---|---|---|
| 5,910,386 | A | 6/1999 | Yoshinaga et al. |
| 6,110,628 | A | 8/2000 | Sekiya et al. |
| 6,258,498 | B1 | 7/2001 | Kawahara et al. |
| 6,296,978 | B1 | 10/2001 | Takaya et al. |
| 6,372,397 | B1 | 4/2002 | Maruyama et al. |
| 6,436,597 | B2 | 8/2002 | Maruyama et al. |
| 6,551,752 | B2 | 4/2003 | Takaya et al. |
| 6,623,899 | B2 | 9/2003 | Takaya et al. |
| 6,664,014 | B1 | 12/2003 | Kikuchi et al. |
| 7,141,341 | B2 | 11/2006 | Sekido et al. |
| 7,333,752 | B2 | 2/2008 | Kawahara et al. |
| 7,378,205 | B2 | 5/2008 | Sekiya et al. |
| 7,551,878 | B2 | 6/2009 | Ogaki et al. |
| 7,622,238 | B2 | 11/2009 | Uematsu et al. |
| 7,629,102 | B2 | 12/2009 | Ochi et al. |
| 7,642,025 | B2 | 1/2010 | Tada et al. |
| 7,718,331 | B2 | 5/2010 | Uematsu et al. |
| 7,749,667 | B2 | 7/2010 | Kawahara et al. |
| 8,088,541 | B2 | 1/2012 | Tanaka et al. |
| 8,343,699 | B2 | 1/2013 | Nagasaka et al. |
| 8,465,889 | B2 | 6/2013 | Sekido et al. |
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,795,936 | B2 | 8/2014 | Sekido et al. |
| 8,841,052 | B2 | 9/2014 | Watariguchi et al. |
| 8,974,991 | B2 | 3/2015 | Kawahara et al. |
| 9,029,054 | B2 | 5/2015 | Okuda et al. |
| 9,063,505 | B2 | 6/2015 | Sekiya et al. |
| 9,068,083 | B2 | 6/2015 | Tanaka et al. |
| 9,069,267 | B2 | 6/2015 | Kaku et al. |
| 9,436,106 | B2 | 9/2016 | Kuno et al. |
| 9,459,542 | B2 | 10/2016 | Tanaka et al. |
| 9,459,545 | B2 | 10/2016 | Tanaka et al. |
| 9,500,966 | B2 | 11/2016 | Watariguchi et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,645,515 | B2 | 5/2017 | Kuno et al. |
| 9,645,516 | B2 | 5/2017 | Kawahara et al. |
| 9,760,030 | B2 | 9/2017 | Sekiya et al. |
| 9,772,568 | B2 | 9/2017 | Sekido et al. |
| 9,811,011 | B2 | 11/2017 | Nishi et al. |
| 9,851,648 | B2 | 12/2017 | Nishi et al. |
| 9,864,285 | B2 | 1/2018 | Nishi et al. |
| 9,869,032 | B2 | 1/2018 | Kawahara et al. |
| 9,921,498 | B2 | 3/2018 | Sekido et al. |
| 10,372,050 | B2 | 8/2019 | Nishi et al. |
| 2008/0096123 | A1 | 4/2008 | Shimada et al. |
| 2014/0141362 | A1 | 5/2014 | Watariguchi et al. |
| 2015/0093693 | A1 | 4/2015 | Watariguchi et al. |
| 2015/0185630 | A1 | 7/2015 | Itolto et al. |
| 2015/0185634 | A1 | 7/2015 | Sekiya et al. |
| 2015/0316863 | A1 | 11/2015 | Tanaka et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2016/0154326 | A1 | 6/2016 | Kumoi et al. |
| 2016/0154328 | A1 | 6/2016 | Kumoi et al. |
| 2020/0159137 | A1 | 5/2020 | Ito et al. |
| 2020/0174385 | A1 | 6/2020 | Sakakibara et al. |

FOREIGN PATENT DOCUMENTS

| | | |
|---|---|---|
| JP | 2000-137340 | 5/2000 |
| JP | 2002-174910 | 6/2002 |
| JP | 2008-076656 | 4/2008 |

OTHER PUBLICATIONS

U.S. Appl. No. 16/904,700, Michiyo Sekiya, filed Jun. 18, 2020.
U.S. Appl. No. 16/904,705, Tomohito Ishida, filed Jun. 18, 2020.
U.S. Appl. No. 16/905,427, Kaname Watariguchi, filed Jun. 28, 2020.
U.S. Appl. No. 17/065,258, Kohei Makisumi.
U.S. Appl. No. 17/070,085, Fumiyuki Hiyama.
U.S. Appl. No. 17/070,179, Kaname Watariguchi.

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus including the electrophotographic photosensitive member.

Description of the Related Art

In recent years, the exposing units used in electrophotographic apparatuses have mainly been semiconductor lasers. Usually, a cylindrical electrophotographic photosensitive member (hereinafter, also referred to as "photosensitive member") is scanned in the axial direction thereof with the laser beam emitted from a light source in a laser scan writer. The optical system such as a polygon mirror and a variety of electrical correction units used at this time control such that the photosensitive member is irradiated with a uniform quantity of light in the axial direction of the photosensitive member.

While reduced cost of the polygon mirror and improved electrical correction techniques promote a size reduction in optical system, and lead to use of electrophotographic laser beam printers in application of personal use, further cost reduction and size reduction have been desired.

Unless the optical system is devised or any electrical correction is performed, the laser light with which the laser scan writer scans has a bias in the distribution of light quantity in the axial direction of the photosensitive member. In particular, because the scan with the laser beam is performed using the polygon mirror and the like, the photosensitive member should have a region where the quantity of light is reduced from the central portion toward the ends in the axial direction of the photosensitive member. If such a bias in the distribution of light quantity is made uniform through control by the optical system and electrical correction, it leads to an increase in cost and size.

In the related art, the exposure potential distribution in the axial direction of the photosensitive member is made uniform by providing a sensitivity distribution in the axial direction of the photosensitive member so as to cancel the bias in the distribution of light quantity.

As a method of providing an appropriate sensitivity distribution in the photosensitive member, it is conceived to dispose a photosensitive layer having an appropriate sensitivity distribution in a monolayer photosensitive member or dispose a charge generating layer having an appropriate sensitivity distribution in a laminated photosensitive member. In addition, it is widely known that if printing of images is repeated, for various reasons, the surface layer of the photosensitive member is scraped, resulting in a reduced film thickness.

Japanese Patent Application Laid-Open No. H04-130433 discloses a technique for varying the film thickness of the charge generating layer in a laminated photosensitive member by controlling the rate in immersion coating such that the sensitivity at both ends of an image formation region is higher than that of the central portion thereof.

Japanese Patent Application Laid-Open No. H08-137115 discloses a technique for preventing a reduction in usage period of a photosensitive member by forming the surface layer of the photosensitive member having an increased film thickness of both ends, where a larger amount of surface layer otherwise would be scraped, compared to that of the central portion thereof.

According to the examination by the present inventors, the electrophotographic photosensitive member according to Japanese Patent Application Laid-Open No. H04-130433 has an unevenness in life in the axial direction of the photosensitive member if an unevenness in potential distribution after exposure of the photosensitive member is reduced.

Accordingly, an object of the present disclosure is to provide an electrophotographic photosensitive member in which an unevenness in potential distribution after exposure of the photosensitive member is reduced while an unevenness in life in the axial direction of the photosensitive member is reduced.

SUMMARY OF THE INVENTION

The above goal is achieved by the present disclosure below. In other words, the electrophotographic photosensitive member according to one aspect of the present disclosure is an electrophotographic photosensitive member including a cylindrical support, a charge generating layer, and a charge transport layer in this order, where when a region from a central position of an image formation region of the electrophotographic photosensitive member to an end position of the image formation region in an axial direction of the cylindrical support is equally divided into five regions, average film thicknesses [nm] of the charge generating layer in the five regions are defined as $d_1$, $d_2$, $d_3$, $d_4$, and $d_5$ from the central position of the image formation region to the end position of the image formation region, and average film thicknesses [μm] of the charge transport layer in the five regions are defined as $D_1$, $D_2$, $D_3$, $D_4$, and $D_5$ from the central position of the image formation region to the end position of the image formation region, a relation represented by $d_1<d_2<d_3<d_4<d_5$ and a relation represented by $D_1<D_2<D_3<D_4<D_5$ are satisfied.

A process cartridge according to another aspect of the present disclosure integrally supports the electrophotographic photosensitive member, and at least one unit selected from the group consisting of a charging unit, a developing unit, a transferring unit, and a cleaning unit, and is detachably attachable to a body of an electrophotographic apparatus.

Furthermore, an electrophotographic apparatus according to another aspect of the present disclosure includes the electrophotographic photosensitive member, a charging unit, an exposing unit, a developing unit, and a transferring unit.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

As a result of the examination by the present inventors, the present inventors have found that in the related art, if the sensitivity distribution of the charge generating layer is provided in the axial direction of the photosensitive member, a larger amount of heat carriers and a larger amount of light carriers are generated in thick portions of the charge generating layer, thereby increasing the amount of the charge transport layer scraped.

According to Japanese Patent Application Laid-Open No. H04-130433, the sensitivity distribution is provided by the charge generating layer having a varied film thickness, and the film thickness of the charge transport layer is made uniform. This results in a larger amount scraped at the ends, and thus a shorter life of the photosensitive member. In a configuration in which the film thickness of the charge generating layer and that of the charge transport layer are increased only at the ends, a sufficient sensitivity distribution enough to reach a uniform post-exposure potential cannot be provided.

To solve the technical problems which have occurred in the related art, the present inventors have examined the influences on the sensitivity distribution and the amount of the charge transport layer scraped by the film thickness distribution of the charge generating layer and the film thickness distribution of the charge transport layer.

As a result of the examination above, the prevent inventors have found that the unevenness in life of the photosensitive member in the axial direction generated in the related art can be solved by an electrophotographic photosensitive member including a cylindrical support, a charge generating layer, and a charge transport layer in this order, where when a region from a central position of an image formation region of the electrophotographic photosensitive member to an end position of the image formation region in an axial direction of the cylindrical support is equally divided into five regions, average film thicknesses [nm] of the charge generating layer in the five regions are defined as $d_1$, $d_2$, $d_3$, $d_4$, and $d_5$ from the central position of the image formation region to the end position of the image formation region, and average film thicknesses [μm] of the charge transport layer in the five regions are defined as $D_1$, $D_2$, $D_3$, $D_4$, and $D_5$ from the central position of the image formation region to the end position of the image formation region, a relation represented by $d_1<d_2<d_3<d_4<d_5$ and a relation represented by $D_1<D_2<D_3<D_4<D_5$ are satisfied.

Figure 1:
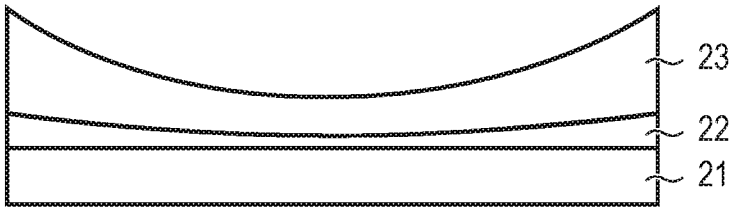
FIG. 1 is a diagram illustrating one example of a layer configuration of the electrophotographic photosensitive member according to one aspect of the present disclosure.
Figure 2:
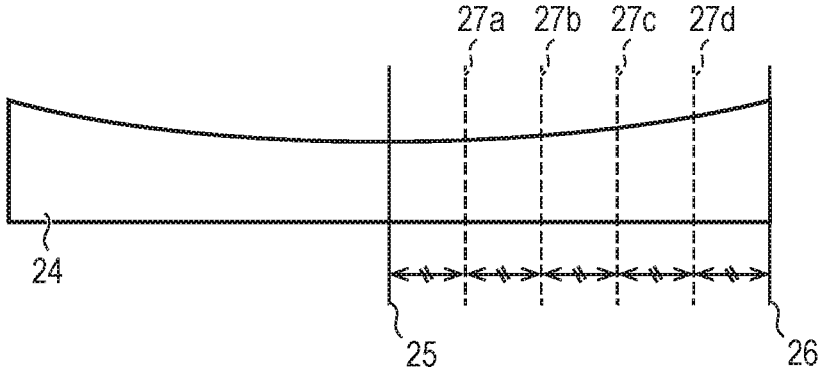
FIG. 2 is a diagram illustrating the electrophotographic photosensitive member according to the present disclosure where the image formation region from the central position to an end position is divided into five equal regions.

In such a configuration described above, the film thickness of the charge generating layer is substantially increased from the central position of the image formation region to the end position of the image formation region. As a result, the content of the charge generating substance is substantially increased from the central position of the image formation region to the end position of the image formation region, providing a photoelectric conversion efficiency distribution substantially increased from the central position of the image formation region to the end position of the image formation region. The expression "the film thickness of the charge generating layer is substantially increased from the central position of the image formation region to the end position of the image formation region" means that the relation represented by $d_1<d_2<d_3<d_4<d_5$ is satisfied when the region from the central position of the image formation region to the end position of the image formation region in the axial direction of the photosensitive member is equally divided into five regions, the average film thicknesses [nm] of the charge generating layer in the five regions are defined as $d_1$, $d_2$, $d_3$, $d_4$, and $d_5$ from the central position of the image formation region of the electrophotographic photosensitive member to the end position of the image formation region. The same applies to the substantial increase of the content of the charge generating substance and that of the photoelectric conversion efficiency. FIG. 1 is a conceptual diagram illustrating a longitudinal cross-section of a photosensitive member. The photosensitive member includes a support 21 of the photosensitive member, a charge generating layer 22, and the charge transport layer 23 above the support 21 in this order. Although not illustrated, as needed, a conductive layer or an undercoat layer may be disposed between the support 21 and the charge generating layer 22, and/or a protective layer may be disposed on the charge transport layer. FIG. 2 is a diagram illustrating the electrophotographic photosensitive member according to the present disclosure where the image formation region from the central position of the electrophotographic photosensitive member to an end position is equally divided into five regions. FIG. 2 illustrates a cross-sectional view 24 of the image formation region of the charge generating layer, a central position 25 of the image formation region, an end position 26 of the image formation region, and internal dividing positions 27*a* to 27*d* when the region ranging from the central position of the image formation region of the electrophotographic photosensitive member to the end position of the image formation region is equally divided into five regions. The average film thickness of the charge generating layer of the region sandwiched between the internal dividing positions 25 and 27*a* is defined as $d_1$ [nm], the average film thickness of the charge generating layer of the region sandwiched between the internal dividing positions 27*a* and 27*b* is defined as $d_2$ [nm], the average film thickness of the charge generating layer of the region sandwiched between the internal dividing positions

27*b* and 27*c* is defined as $d_3$ [nm], the average film thickness of the charge generating layer of the region sandwiched between the internal dividing positions 27*c* and 27*d* is $d_4$ [nm], and the average film thickness of the charge generating layer of the region sandwiched between the internal dividing position 27*d* and the end position 26 is defined as $d_5$ [nm].

The present inventors think the following mechanism about how the unevenness in distribution of the exposure potential can be reduced and the reduction in life of the photosensitive member can be solved in the configuration described above.

Firstly, the unevenness in distribution of the post-exposure potential is caused because the quantity of light entering the charge generating layer is different in the axial direction. Unless the optical system is devised or electrical correction is performed, the light emitted onto the photosensitive member is reduced from the central position toward the end positions in the axial direction of the photosensitive member, causing an unevenness in the quantity of light. On the other hand, the sensitivity depends on the film thickness of the charge generating layer. As the film thickness of the charge generating layer increases from the central position to the end positions and thus the sensitivity also increases, which cause an unevenness in sensitivity. The unevenness in distribution of the post-exposure potential can be reduced because the unevenness in the quantity of light and the unevenness in sensitivity cancel each other out.

Secondly, the unevenness in life of the photosensitive member is caused because the amount of carriers generated from the charge generating substance is different in the axial direction. The carriers generated in the charge generating layer pass through the charge transport layer to cancel out the surface potential of the photosensitive member. If this process occurs in the charge unit in the electrophotographic process, the amount discharged to the photosensitive member is increased in the charge unit, increasing damage to the charge transport layer and the amount of the charge transport layer scraped.

The carriers generated in the charge generating layer to cause an increase in the amount discharged are heat carriers and light carriers. Both of these carriers increase as the amount of the charge generating substance is larger. Thus, a larger film thickness of the charge generating layer results in an increase in the amount of the charge transport layer scraped therein. Especially, a large amount of light carriers is generated by pre-exposure in the electrophotographic process, and therefore is significantly responsible for generation of the unevenness in life of the photosensitive member.

The amount of pre-exposure to cancel out the charged charges is usually uniform in the axial direction of the photosensitive member. For this reason, the amount of the charge transport layer scraped is increased toward the end positions having a large film thickness of the charge generating layer, and the life is reduced. Accordingly, the unevenness in life of the photosensitive member in the axial direction can be reduced by increasing the film thickness of the charge transport layer from the central position towards the end positions in the axial direction of the photosensitive member.

The effects of the present disclosure can be achieved as such a mechanism above where the film thickness distribution of the charge generating layer used in the present disclosure can reduce the unevenness in distribution of the post-exposure potential while the film thickness distribution of the charge transport layer is provided so as to just cancel out the distribution of the amount of the charge transport layer scraped generated along the film thickness distribution of the charge generating layer.

[Electrophotographic Photosensitive Member]

The electrophotographic photosensitive member according to one aspect of the present disclosure includes a charge generating layer and a charge transport layer.

Examples of a method of producing the electrophotographic photosensitive member according to one aspect of the present disclosure include a method of preparing coating solutions of layers described later, and applying the coating solutions in a desired order of layers, followed by drying. At this time, examples of a method of applying the coating solution include immersion coating, spray coating, ink jet coating, roll coating, die coating, blade coating, curtain coating, wire bar coating, and ring coating. Among these, preferred is immersion coating from the viewpoint of efficiency and productivity.

When the region from the central position of the image formation region of the electrophotographic photosensitive member to the end position of the image formation region in the axial direction of the photosensitive member is equally divided into five regions, $D_1$, $D_2$, $D_3$, $D_4$, and $D_5$ are defined as average film thicknesses [nm] of the charge transport layer in the five regions in the order from the central position of the image formation region to the end position of the image formation region. Preferably, the pulling rate in immersion coating is controlled to form a charge transport layer which satisfies the relation represented by $D_1<D_2<D_3<D_4<D_5$. In this case, for example, the pulling rate is set for each of eleven points of the photosensitive member in the axial direction thereof, and is smoothly changed between adjacent two points during immersion coating. Such an operation enables the control. At this time, the eleven points for setting the pulling rate do not need to be located at an equal interval in the axial direction of the photosensitive member. Rather, from the viewpoint of the precision in control of the film thickness of the charge transport layer, it is preferred that the setting points of the pulling rate be selected such that the values of the pulling rates are equal.

When the film thickness distribution of the charge transport layer according to the present disclosure is formed by the control of the pulling rate during immersion coating, a charge transport layer coating prior to drying may sag due to gravity in a region of the photosensitive member in the axial direction thereof where the state in which the pulling rate is high and the film thickness of the charge transport layer is large is changed to the state where the pulling rate is low and the film thickness of the charge transport layer is small. Such a sag phenomenon leads to the generation of an uneven film thickness of the charge transport layer in the circumferential direction of the photosensitive member, causing a problem with images. To solve this problem, i.e., to prevent sagging during immersion coating, one of effective methods is to increase the viscosity of the coating solution or to reduce the film thickness before drying.

[Process Cartridge, Electrophotographic Apparatus]

In the electrophotographic photosensitive member, the surface layer is scraped and the film thickness is reduced due to a variety of factors such as contact with a cleaning unit or a charging unit, discharge by the charging unit, and generation of carriers by a pre-exposing unit described later.

The process cartridge according to another aspect of the present disclosure integrally supports the electrophotographic photosensitive member according to one aspect of the present disclosure and at least one unit selected from the group consisting of a charging unit, a developing unit, a transferring unit, and a cleaning unit, and is detachably attachable to the body of an electrophotographic apparatus.

The electrophotographic apparatus according to further another aspect of the present disclosure includes the electrophotographic photosensitive member according to one aspect of the present disclosure, a charging unit, an exposing unit, a developing unit, and a transferring unit.

Figure 3:
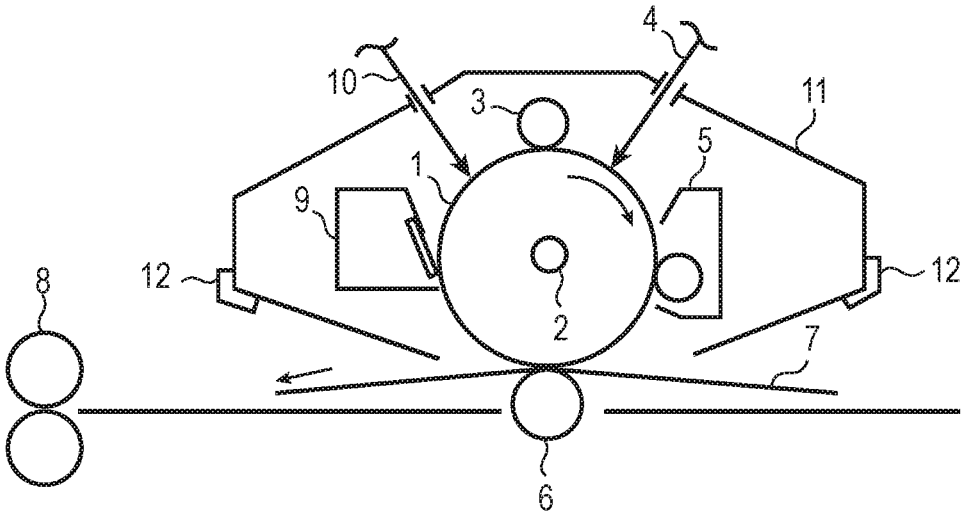
FIG. 3 is a diagram illustrating one example of a schematic configuration of an electrophotographic apparatus including a process cartridge including an electrophotographic photosensitive member according to one aspect of the present disclosure.

FIG. 3 illustrates one example of a schematic configuration of an electrophotographic apparatus including a process cartridge including an electrophotographic photosensitive member.

A cylindrical electrophotographic photosensitive member 1 is rotatably driven around a shaft 2 as the center in the arrow direction at a predetermined circumferential speed. The surface of the electrophotographic photosensitive member 1 is charged to a predetermined potential, i.e., a positive or negative potential by a charging unit 3. Although a roller charging system by a roller type charging member is illustrated in the drawing, another charging system such as a corona charging system, an approach charging system, or an injection charging system may be used. The surface of the charged Electrophotographic photosensitive member 1 is irradiated with exposure light 4 from an exposing unit (not illustrated) to form an electrostatic latent image corresponding to the image information of interest. The electrostatic latent image formed on the surface of the electrophotographic photosensitive member 1 is developed with a toner accommodated in a developing unit 5 to form a toner image on the surface of the electrophotographic photosensitive member 1. The toner image formed on the surface of the electrophotographic photosensitive member 1 is transferred onto a transfer material 7 by a transferring unit 6. The transfer material 7 having the transferred toner image is conveyed to a fixing unit 8, and the toner image is fixed. The transfer material 7 is discharged to the outside of the electrophotographic apparatus (print out). The electrophotographic apparatus may include a cleaning unit 9 for removing adherents, such as the toner, which adhere to the surface of the electrophotographic photosensitive member 1 after transfer. A so-called cleaner-less system which removes adherents using the developing unit or the like be used, rather than the cleaning unit is separately disposed. The electrophotographic apparatus may include a discharge mechanism which discharges the surface of the electrophotographic photosensitive member 1 with pre-exposure light 10 from a pre-exposing unit (not illustrated). Moreover, a guide unit 12 such as a rail may be disposed to attach/detach a process cartridge 11 according to another aspect of the present disclosure to/from the body of an electrophotographic apparatus.

The electrophotographic photosensitive member according to the present disclosure can be used in laser beam printers, LED printers, copiers, fax machines, and multifunction machines thereof.

Figure 4:
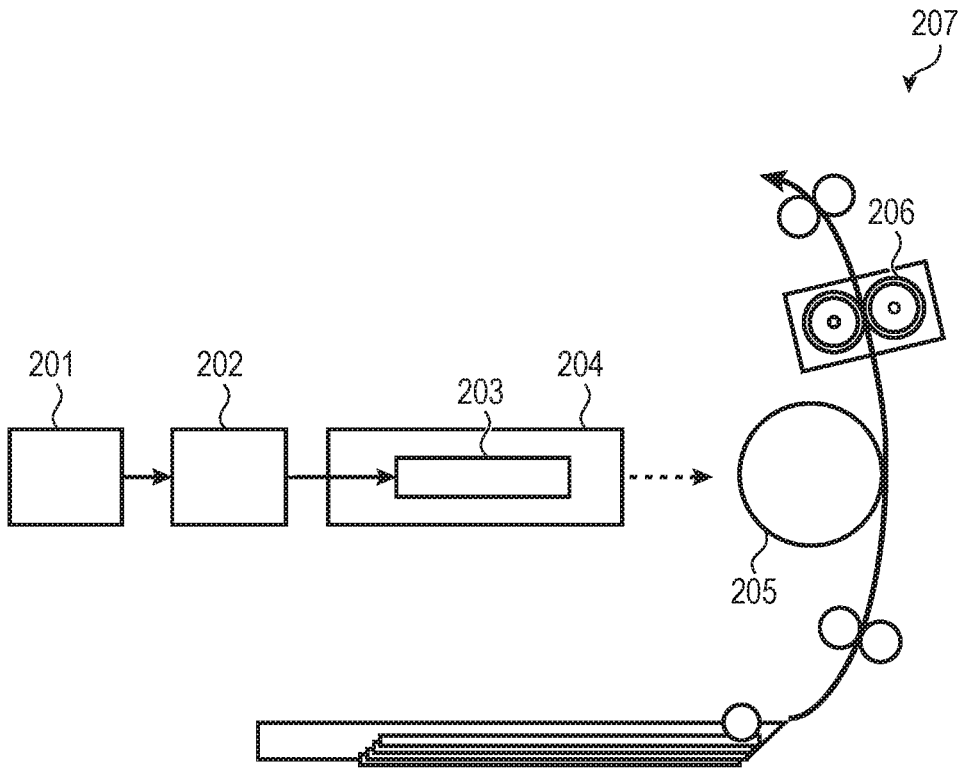
FIG. 4 is a diagram illustrating one example of a schematic configuration of an exposing unit in the electrophotographic apparatus including the electrophotographic photosensitive member according to one aspect of the present disclosure.

FIG. 4 illustrates one example of a schematic configuration 207 of the exposing unit in the electrophotographic apparatus including the electrophotographic photosensitive member according to one aspect of the present disclosure.

A laser drive unit 203 inside a laser scan unit 204 as a laser scan unit emits laser scan light based on an image signal output from image signal generator 201 and a control signal output from a control unit 202. A charged photosensitive member 205 charged by a charging unit (not illustrated) is scanned with the laser light to form an electrostatic latent image on a surface of a photosensitive member 205. A transfer material having a toner image formed from the electrostatic latent image formed on the surface of the photosensitive member 205 is conveyed to a fixing unit 206, and the toner image is fixed. The transfer material is discharged to the outside of the electrophotographic apparatus (print out).

Figure 5:
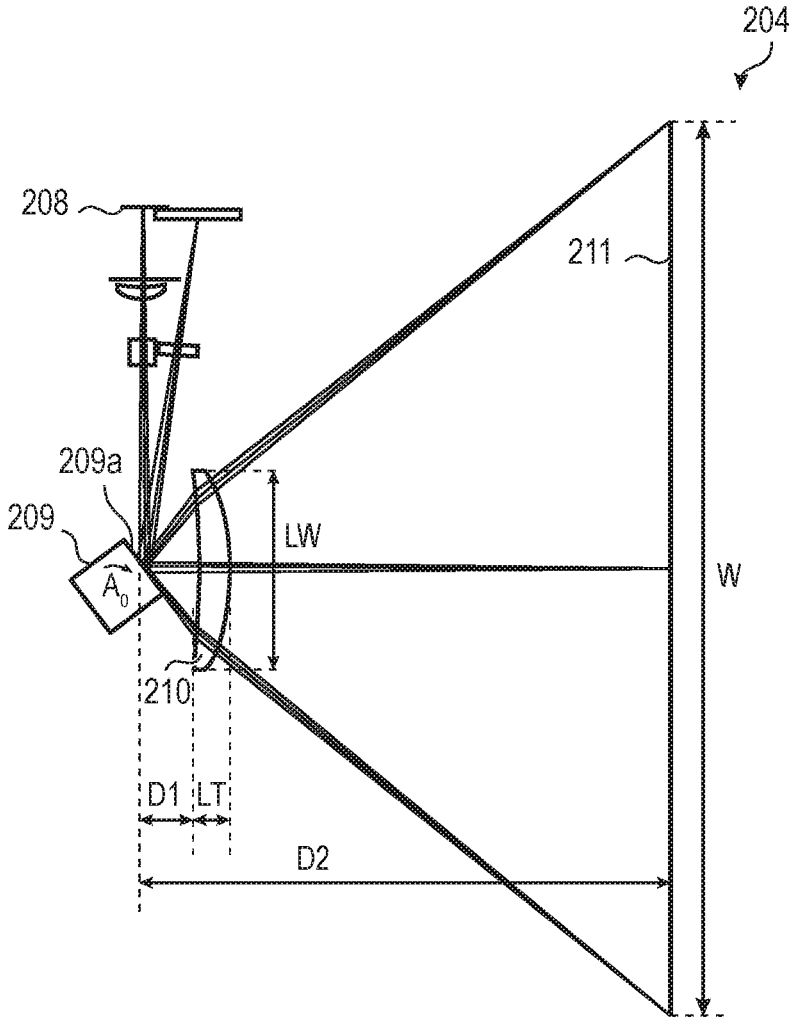
FIG. 5 is a cross-sectional view of a laser scan unit in the electrophotographic apparatus including the electrophotographic photosensitive member according to one aspect of the present disclosure.

FIG. 5 is a cross-sectional view of the laser scan unit 204 in the electrophotographic apparatus including the electrophotographic photosensitive member according to the present disclosure.

The laser light (luminous flux) emitted from a laser light source 208 passes through an optical system, and is reflected by a deflecting surface (reflecting surface) 209*a* of a polygon mirror (deflector) 209. The laser light passes through an image forming lens 210, and enters the surface of a photosensitive member 211. The image forming lens 210 is an image forming optical element. In the laser scan unit 204, the image forming optical system is composed of only a single image forming optical element (image forming lens 210). The laser light passing through the image forming lens 210 forms an image on the surface of the photosensitive member (the surface to be scanned) 211 to form a predetermined spot-like image (spot). By rotating the polygon mirror 209 at a constant angular velocity $A_0$ by a drive unit (not illustrated), the spot moves on the surface 211 to be scanned in the axial direction of the photosensitive member to form an electrostatic latent image on the surface 211 to be scanned.

The image forming lens 210 does not have so-called fθ characteristics. In other words, the image forming lens 210 does not have scanning characteristics such that the spot of the laser light passing through the image forming lens 210 is moved at a constant velocity on the surface 211 to be scanned when the polygon mirror 209 is rotating at a constant angular velocity. By way of the image forming lens 210 without the fθ characteristics, the image forming lens 210 can be disposed close to the polygon mirror 209 (at a position to provide a small distance L1). The image forming lens 210 without the fθ characteristics can have a reduced width LW and thickness LT compared to an image forming lens having the fθ characteristics. Thus, the size of the laser scan unit 204 can be reduced. Moreover, the lens having the fθ characteristics may have sharp changes in the shape of the incident surface of the lens and that of the light-emitting surface in some cases. If the lens has such a restriction on the shape, favorable image forming performance may not be obtained. In contrast, the image forming lens 210 does not have the fθ characteristics. Thus, such sharp changes in the shape of the incident surface of the lens and that of the light-emitting surface are reduced, and favorable image forming performance can be obtained.

The scanning characteristics of such an image forming lens 210 without the fθ characteristics which provides the effects of size reduction and improved image forming performance is represented by Equation (E16):

$$Y = \frac{K}{B}\tan(B\theta) \tag{E16}$$

In Equation (E16), the scan angle formed by the polygon mirror 209 is defined as θ, the light converged position (image height) of laser light on the surface 211 to be scanned in the axial direction of the photosensitive member is defined as Y [mm], the image forming coefficient at the image height on the axis is defined as K [mm], and the coefficient (scanning characteristic coefficient) for determining the scanning characteristics of the image forming lens 210 is defined as B. In the present disclosure, the image height on the axis indicates an image height on an optical axis ($Y=0=Y_{min}$), and corresponds to the scan angle $\theta=0$. The image height out of the axis indicates an image height ($Y\neq0$) out of the central optical axis (where the scan angle $\theta=0$), and corresponds to the scan angle $\theta\neq0$. Furthermore, the maximum image height out of the axis indicates image heights ($Y=+Y'_{max}$, $-Y'_{max}$) when the scan angle $\theta$ is the maximum. The scan width W is represented by $W=|+Y'_{max}|+|-Y'_{max}|$, where the scan width W is a width of a predetermined region (scan region) in the axial direction of the photosensitive member in which a latent image on the surface 211 to be scanned can be formed. Approximately the center of the predetermined region is the image height on the axis while the ends thereof are maximum image heights out of the axis. The scan region is larger than the image formation region of the photosensitive member according to the present disclosure.

Here, the image forming coefficient K is a coefficient corresponds to fin the scanning characteristics ($f\theta$ characteristics) $Y=f\theta$ assuming that the image forming lens 210 has the $f\theta$ characteristics. In other words, the image forming coefficient K is a coefficient for ensuring the proportional relation between the light converged position Y and the scan angle $\theta$ in the image forming lens 210 similarly to the $f\theta$ characteristics.

Giving additional remarks on the scanning characteristics coefficient, $Y=K\theta$ at $B=0$ in Equation (E16), and is equivalent to the scanning characteristics $Y=f\theta$ of the image forming lens used in a conventional light scan unit. Moreover, $Y=K\cdot\tan\theta$ at $B=1$ in Equation (E16), and corresponds to the projection characteristics $Y=f\cdot\tan\theta$ of the lens used in imaging devices (cameras). In other words, by setting the scanning characteristics coefficient B in the range of $0\leq B\leq1$ in Equation (E16), the scanning characteristics between the projection characteristics $Y=f\cdot\tan\theta$ and the $f\theta$ characteristics $Y=f\theta$ can be obtained.

Here, when Equation (E16) is differentiated with respect to the scan angle $\theta$, a scan rate of the laser light on the surface 211 to be scanned with respect to the scan angle $\theta$ is obtained as represented by Equation (E17):

$$\frac{dY}{d\theta}=\frac{K}{\cos^2(B\theta)} \tag{E17}$$

Furthermore, Equation (E17) is divided by the speed $Y/\theta=K$ at the image height on the axis, and the inverse numbers of both sides of the equation are taken to obtain Equation (E18):

$$\left(\frac{1}{K}\frac{dY}{d\theta}\right)^{-1}=\cos^2(B\theta) \tag{E18}$$

Equation (E18) represents the proportion of the inverse number of the scan rate at each image height out of the axis to the inverse number of the scan rate at the image height on the axis. Since the total energy of the laser light is constant irrespective of the scan angle $\theta$, the inverse number of the scan rate of the laser light on the surface 211 to be scanned of the surface of the photosensitive member is proportional to the quantity [$\mu J/cm^2$] per unit area of the laser light emitted to a place defined by the scan angle $\theta$. Accordingly, Equation (E18) means the proportion of the quantity per unit area of the laser light emitted to the surface 211 to be scanned of the surface of the photosensitive member where the scan angle $\theta\neq0$ to that of the laser light emitted to the surface 211 to be scanned of the surface of the photosensitive member where the scan angle $\theta=0$. At $B\neq0$, in the laser scan unit 204, the quantity per unit area of the laser light emitted to the surface 211 to be scanned of the surface of the photosensitive member is different between the case at the image height on the axis and that at the image height out of the axis.

If the distribution of the laser light quantity described above is present in the axial direction of the photosensitive member, the electrophotographic photosensitive member according to the present disclosure having a sensitivity distribution in the axial direction of the photosensitive member can be suitably used. In other words, if a sensitivity distribution to just cancel out the distribution of the laser light quantity is implemented with the configuration according to the present disclosure, a photosensitive member having a uniform exposure potential distribution in the axial direction is provided. The shape of the distribution of the sensitivity determined at this time is represented by Equation (E19) obtained by taking the inverse numbers of Equation (E18):

$$\frac{1}{K}\frac{dY}{d\theta}=\frac{1}{\cos^2(B\theta)} \tag{E19}$$

Where the scan angle corresponding to the end of the image formation region of the photosensitive member is defined as $\theta=\theta_{max}$, the value of Equation (E19) at $\theta=\theta_{max}$ indicates a sensitivity ratio r, that is, the proportion of the photoelectric conversion efficiency at the end of the image formation region to that in the central portion of the image formation region, which is determined for the photosensitive member when the photosensitive member according to one aspect of the present disclosure is combined with the laser scan unit described above. If the value of r is fixed, the geometric characteristic $\theta_{max}$ of the laser scan unit and the scanning characteristics coefficient B of the optical system which are allowed to form a uniform exposure potential distribution in the image formation region in the axial direction of the photosensitive member are fixed. Specifically, when the condition represented by Equation (E20) is satisfied, a uniform exposure potential distribution in the axial direction of the photosensitive member can be provided in the image formation region of the photosensitive member according to one aspect of the present disclosure.

$$r=\frac{1}{\cos^2(B\theta_{max})} \tag{E20}$$

Equation (E20) is solved for $\theta_{max}$ to get Equation (E21):

$$\theta_{max}=\frac{1}{B}\arccos\sqrt{r} \tag{E21}$$

Figure 6:
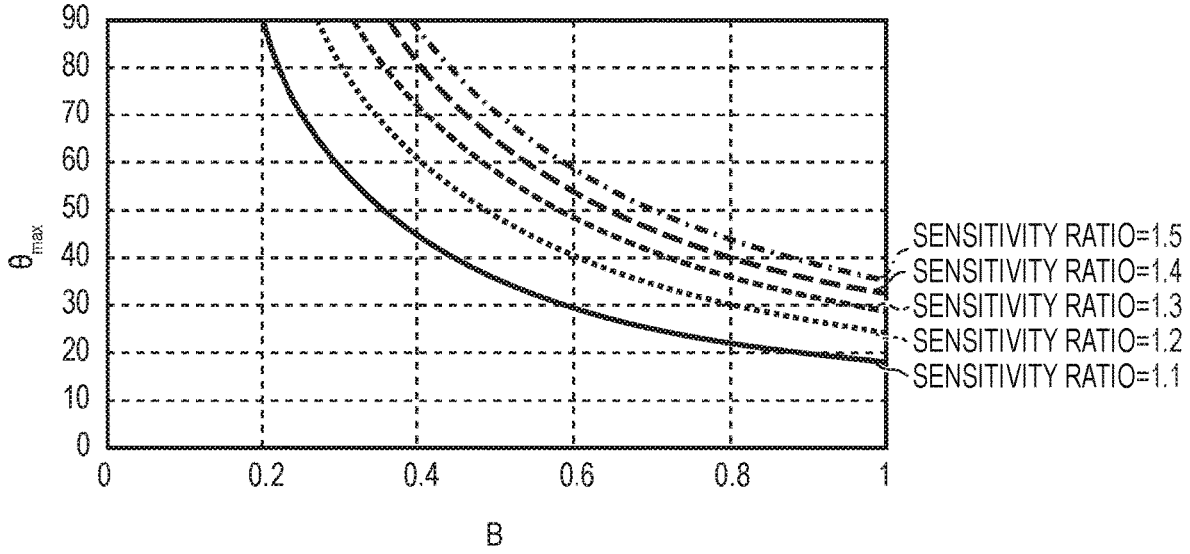
FIG. 6 is a graph showing the relation among the sensitivity ratio in the image formation region of the electrophotographic photosensitive member according to one aspect of the present disclosure, the geometric characteristic $\theta_{max}$ of the laser scan unit, and the scan characteristic coefficient B of the optical system.

A graph of Equation (E21) is shown in FIG. 6. Apparently from FIG. 6, for example, if a photosensitive member according to the present disclosure having a sensitivity ratio r of 1.2 is combined with an image forming lens 210 having a scanning characteristics coefficient B of 0.5 and a laser scan unit 204 is designed such that $\theta_{max}$=48°, a uniform exposure potential distribution can be provided in the image formation region of the photosensitive member. On the other hand, for example, even if a photosensitive member according to the present disclosure having a sensitivity ratio r of 1.1 is combined with an image forming lens 210 having a scanning characteristics coefficient B of 0.5 and a laser scan unit 204 is designed such that $\theta_{max}$=48°, a partial unevenness in the exposure potential distribution is generated in the image formation region of the photosensitive member. Although $\theta_{max}$=35° is needed to provide a uniform exposure potential distribution at this time, this value is smaller than $\theta_{max}$=48°. As a value of $\theta_{max}$ is larger, the optical path length L2 from a deflecting surface 209*a* to the surface 211 to be scanned of the surface of the photosensitive member illustrated in FIG. 5 is shorter, resulting in a size reduction of the laser scan unit 204. Accordingly, as the sensitivity ratio r in the central portion of the image formation region and that of the end of the image formation region in the axial direction of the photosensitive member is larger, a laser beam printer including the photosensitive member according to one aspect of the present disclosure having such a configuration can have a reduced size.

The support and the layers which constitute the electrophotographic photosensitive member according to one aspect of the present disclosure will now be described in detail.

<Support>

In the present disclosure, the electrophotographic photosensitive member includes a support. In the present disclosure, the support is preferably a conductive support having conductivity. Examples of the shape of the support include cylindrical shapes, belt-like shapes, and sheet-like shapes. Among these, preferred is a cylindrical support. The support may have a surface subjected to an electrochemical treatment such as anode oxidation, or a process such as blasting or machining.

Preferred materials for the support are metals, resins, and glass.

Examples of the metals include aluminum, iron, nickel, copper, gold, stainless steel, and alloys thereof. Among these, preferred is an aluminum support made of aluminum.

Conductivity may be imparted to resins and glass by mixing or coating a conductive material to or with these.

<Conductive Layer>

In the present disclosure, a conductive layer is preferably disposed on the support. The conductive layer disposed thereon can cover scratches and/or irregularities on the surface of the support, and can control the reflection of the light on the surface of the support.

The conductive layer preferably contains conductive particles and a resin.

Examples of the material for the conductive particles include metal oxides, metals, and carbon black. Examples of the metal oxides include zinc oxide, aluminum oxide, indium oxide, silicon oxide, zirconium oxide, tin oxide, titanium oxide, magnesium oxide, antimony oxide, and bismuth oxide. Examples of the metals include aluminum, nickel, iron, nichrome, copper, zinc, and silver.

Among these, the conductive particles to be used are preferably metal oxides, particularly, more preferably titanium oxide, tin oxide, and zinc oxide.

If a metal oxide is used as the conductive particles, the surface of the metal oxide may be treated with a silane coupling agent, or the metal oxide may be doped with the elements of a phosphorus, aluminum or the like, or an oxide thereof.

The conductive particles may have a layer configuration composed of particles of a core material and a coating layer applied onto the particles. Examples of the particles of a core material include those of titanium oxide, barium sulfate, and zinc oxide. Examples of the coating layer include those of metal oxides such as tin oxide.

If a metal oxide is used as the conductive particles, the volume average particle size is preferably 1 nm or more and 500 nm or less, more preferably 3 nm or more and 400 nm or less.

Examples of the resins include polyester resins, polycarbonate resins, poly(vinyl acetal) resins, acrylic resins, silicone resins, epoxy resins, melamine resins, polyurethane resins, phenol resins, and alkyd resins.

The conductive layer may further contain a covering agent such as silicone oil, resin particles, or titanium oxide.

The conductive layer has an average film thickness of preferably 1 μm or more and 50 μm or less, more preferably 3 μm or more and 40 μm or less.

To more effectively obtain the exposure potential distribution in the axial direction of the photosensitive member according to the present disclosure, it is particularly preferred that the conductive layer have a film thickness of 10 μm or more, and the conductive layer contain a binder resin and fine particles of a metal oxide having an average diameter of 100 nm or more and 400 nm or less. If the fine particles of a metal oxide have an average diameter of 100 nm or more and 400 nm or less, a laser in a wavelength region of submicrometers recently used as an exposure light source for electrophotographic apparatus is well scattered. If the conductive layer has a film thickness of 10 μm or more, the laser light travels a distance of 20 μm or more when the laser light enters the photosensitive member, passes through the conductive layer, is reflected by the cylindrical support, and again passes through the conductive layer to reach the charge generating layer. This distance is 10 times or more the wavelength of the exposure laser used, the laser light traveling such a long distance while being scattered will sufficiently lose its coherency. For this reason, the laser light, which is reflected and reenters the charge generating layer, has a reduced transmittance to the charge generating layer, and is well absorbed in the charge generating layer. This results in a substantial improvement in sensitivity of the photosensitive member. Such a mechanism can effectively provide the sensitivity distribution according to the present disclosure with the above-mentioned configuration of the conductive layer even if the charge generating layer has a small film thickness. At the same time, formation of the charge generating layer having a small film thickness results in a reduction in the amount of light carriers generated by pre-exposure. As a result, the absolute value of the amount of the charge transport layer scraped can be reduced, and the absolute value of the life of the photosensitive member according to the present disclosure is increased. For this reason, the conductive layer described above demonstrates a synergistically effect to the sensitivity and the life in the present disclosure.

From the viewpoint of effectively providing the sensitivity distribution according to the present disclosure as described above and further improving the image quality when the electrophotographic photosensitive member according to the present disclosure is used, the fine particles of a metal oxide contained in the conductive layer preferably contain a core material containing titanium oxide, and more preferably contain the core material and a coating layer coating the core material and containing titanium oxide doped with niobium or tantalum. Titanium oxide has a refractive index higher than that of tin oxide, which is often used as a coating layer. Accordingly, if the core material of the fine particles of a metal oxide and the coating layer both contain titanium oxide, the exposure laser entering the photosensitive member is prevented from invading the conductive layer after passing through the charge generating layer, and is readily reflected or scattered near the interface of the conductive layer close to the charge generating layer. It is believed that as the exposure laser is scattered more in a position remote from the interface of the charge generating layer close to the conductive layer in the conductive layer, the irradiation region of the charge generating layer with the exposure laser substantially becomes broader to reduce the precision of the latent image, and thus the precision of the output image. A combination of the conductive layer having the configuration above with the charge generating layer according to the present disclosure can provide compatibility between a substantial increase in sensitivity of the photosensitive member caused by scattering of the exposure laser and a substantial prevention of broadening of the irradiation region of the charge generating layer with the exposure laser, further improving the image quality due to an improvement in precision of the output image.

The conductive layer can be formed by preparing a coating solution for a conductive layer containing the above-mentioned materials and a solvent, and forming and drying a coating thereof. Examples of the solvent used for the coating solution include alcohol solvents, sulfoxide solvents, ketone solvents, ether solvents, ester solvents, and aromatic hydrocarbon solvents. Examples of a dispersion method for dispersing conductive particles in the coating solution for a conductive layer include those using a paint shaker, a sand mill, a ball mill, or a solution collision high-speed dispersing machine.

<Undercoat Layer>

In the present disclosure, an undercoat layer may be disposed on the support or the conductive layer. The undercoat layer disposed thereon can enhance the adhesion function between layers to impart a function to prevent charge injection.

The undercoat layer preferably contains a resin. Alternatively, the undercoat layer may be a cured film formed by polymerizing a composition containing a monomer having a polymerizable functional group.

Examples of the resin include polyester resins, polycarbonate resins, polyvinylacetal resins, acrylic resins, epoxy resins, melamine resins, polyurethane resins, phenol resins, poly(vinylphenol) resins, alkyd resins, poly(vinyl alcohol) resins, polyethylene oxide resins, polypropylene oxide resins, polyamide resins, polyamic acid resins, polyimide resins, polyamidimide resins, and cellulose resins.

Examples of the polymerizable functional group contained in the monomer having a polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group, and a carbon-carbon double bond.

To enhance electrical properties, the undercoat layer may further contain an electron transport substance, a metal oxide, a metal, and a conductive polymer. Among these, preferred is use of an electron transport substance and a metal oxide.

Examples of the electron transport substance include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. An electron transport substance having a polymerizable functional group may be used as the electron transport substance, and may be copolymerized with the monomer having a polymerizable functional group above to form an undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

The undercoat layer may further contain additives.

The undercoat layer has an average film thickness of preferably 0.1 μm or more and 50 μm or less, more preferably 0.2 μm or more and 40 μm or less, particularly preferably 0.3 μm or more and 30 μm or less.

The undercoat layer can be formed by preparing a coating solution for an undercoat layer containing the above-mentioned materials and a solvent, forming a coating thereof, and drying and/or curing the coating. Examples of the solvent used for the coating solution include alcohol solvents, ketone solvents, ether solvents, ester solvents, and aromatic hydrocarbon solvents.

<Photosensitive Layer>

The photosensitive layer included in the electrophotographic photosensitive member includes a charge generating layer containing a charge generating substance, and a charge transport layer containing a charge transport substance.

(1-1) Charge Generating Layer

The charge generating layer preferably contains a charge generating substance and a resin.

Examples of the charge generating substance include azo pigments, perylene pigments, polycyclic quinone pigments, indigo pigments, and phthalocyanine pigments. Among these, preferred are azo pigments and phthalocyanine pigments. Among phthalocyanine pigments, more preferred are those containing hydroxygallium phthalocyanine crystals described in Japanese Patent Application Laid-Open No. 2000-137340 having strong peaks at Bragg angle 2θ of 7.4°±0.3° and 28.2°±0.3° in CuKα characteristic X-ray diffraction or titanyl phthalocyanine crystals described in Japanese Patent Application Laid-Open No. 2000-137340 having a strong peak at Bragg angle 2θ of 27.2°±0.3° in CuKα characteristic X-ray diffraction.

The content of the charge generating substance in the charge generating layer is preferably 40% by mass or more and 85% by mass or less, more preferably 60% by mass or more and 80% by mass or less relative to the total mass of the charge generating layer.

Examples of the resin include polyester resins, polycarbonate resins, polyvinyl acetal resins, poly(vinyl butyral) resins, acrylic resins, silicone resins, epoxy resins, melamine resins, polyurethane resins, phenol resins, poly(vinyl alcohol) resins, cellulose resins, polystyrene resins, poly(vinyl acetate) resins, and poly(vinyl chloride) resins. Among these, poly(vinyl butyral) resins are more preferred.

The charge generating layer may further contain additives such as an antioxidant and an ultraviolet absorbing agent. Specifically, examples thereof include hindered phenol compounds, hindered amine compounds, sulfur compounds, phosphorus compounds, and benzophenone compounds.

The film thickness distribution of the charge generating layer according to the present disclosure was measured as follows.

First, a region from the central position of an image formation region to an end position of the image formation region in the axial direction of the cylindrical electrophotographic photosensitive member according to the present disclosure is equally divided into five regions. In the next step, each of the five regions thus obtained is equally divided into four in the axial direction and eight in the circumferential direction, and the film thickness of the charge generating layer is measured at 32 points. The average of the 32 film thicknesses is defined as the average film thickness [nm] of each equal region of the charge generating layer. In other words, the average film thicknesses of the five regions from the central position of the image formation region to the end position of the image formation region is defined as $d_1$, $d_2$, $d_3$, $d_4$, and $d_5$ in sequence.

The central position of the image formation region in the present disclosure indicates a position in the axial direction at Y=0 where Y is the image height in Equation (E3), and may be deviated in the axial direction up to 10% of the length of the image formation region in the axial direction with respect to the central position of the image formation region divided into two in the axial direction of the photosensitive member.

The film thickness distribution of the charge generating layer preferably satisfies the relation represented by Equation (E22) where the light absorption coefficient of the charge generating layer is β [$nm^{-1}$]:

$$\frac{1-e^{-2\beta d_6}}{1-e^{-2\beta d_0}} \geq 1.2 \tag{E22}$$

The light absorption coefficient β herein is defined by the Lambert-Beer law, which is represented by Equation (E23):

$$\frac{I}{I_0} = 1 - e^{-\beta d} \tag{E23}$$

where $I_0$ represents the total energy of light entering a film having a film thickness d [nm], and I represents the energy of light absorbed by the film having a film thickness d [nm]. The film thickness do and the film thickness $d_6$ each are defined as an average of the film thicknesses of the charge generating layer when measured at 32 points in a region divided into four in the axial direction and into eight in the circumferential direction, assuming that the region is a region which has a width of $Y_{max}/20$ [mm] in the axial direction with respect to a center, which is the central position of the image formation region or the end position of the image formation region, and is defined by making one turn around the center in the circumferential direction.

Apparently from Equation (E23), the numerator in the left side in Equation (E22) represents the light absorptivity at the end position of the image formation region and the denominator in the left side represents the light absorptivity at the central position of the image formation region. Accordingly, Equation (E22) means that the light absorptivity at the end position is 1.2-fold or higher than that at the central position. Such a configuration can impart an at least 1.2-fold difference in sensitivity to the image formation region in the axial direction of the photosensitive member, and thus can flexibly treat with a deviation of the actual light quantity distribution generated by size reduction of the optical system in the laser scan system of the electrophotographic apparatus. In Equation (E22), the exponents include 2 because the exposure laser passing through the charge generating layer is reflected on the photosensitive member support and then passes through the charge generating layer again.

Furthermore, where the distance from the central position of the image formation region in the axial direction of the photosensitive member is Y mm, the value Y at the end position of the image forming region is $Y_{max}$ mm, and the difference ($d_6$–$d_0$) between $d_6$ and do is 4, for all the values of Y where $0 \leq Y \leq Y_{max}$, the value of d(Y) calculated from Equation (E24) is preferably between (d−0.2Δ) and (d+0.2Δ) in the film thickness distribution of the charge generating layer:

$$d(Y) = d_0 + \Delta(1-\beta\Delta)\frac{Y^2}{Y_{max}^2} + \beta\Delta^2\frac{Y^4}{Y_{max}^4} \tag{E24}$$

where Y is equal to the image height Y described above, and $Y_{max}$ is smaller than the maximum image height $Y'_{max}$ out of the axis described above.

The film thicknesses of the charge generating layer for all the values of Y where $0 \leq Y \leq Y_{max}$ are measured as follows. In other words, d(Y) is defined as an average of the film thicknesses of the charge generating layer in the axial direction of the photosensitive member when measured at 32 points in a region divided into four in the axial direction and into eight in the circumferential direction, assuming that the region is a region which has a width of $Y_{max}/5$ mm in the axial direction with respect to a center, which is a point located at a distance of Y mm from the central position of the image formation region, and is defined by making one turn around the center in the circumferential direction.

The present inventors have found that by forming a charge generating layer having a film thickness distribution represented by a quartic function represented by Equation (E24), a quantity light distribution in the axial direction of the photosensitive member is appropriately cancelled out when the photosensitive member is scanned with an exposure laser from an optical system having properties represented by Equation (E25), and a highly uniform exposure potential distribution in the axial direction of the photosensitive member can be provided. The mechanism will now be described.

As described above, to obtain a uniform exposure potential distribution in an optical system having properties represented by Equation (E25):

$$Y = \frac{K}{B}\tan(B\theta) \tag{E25}$$

it is sufficient that the photosensitive member has a shape of sensitivity distribution represented by Equation (E26):

$$\frac{1}{K}\frac{dY}{d\theta} = \frac{1}{\cos^2(B\theta)} \tag{E26}$$

In the present disclosure, the sensitivity is determined by the photoelectric conversion efficiency calculated from the film thickness of the charge generating layer according to the Lambert-Beer law. For this reason, the exposure potential distribution becomes uniform when $d_6$ in the left side of Equation (E22) is replaced with the film thickness d(Y) of the charge generating layer at any Y (where $0 \leq Y \leq Y_{max}$) is equal to the right side of Equation (E26), that is, the relation represented by Equation (E27) is satisfied.

$$\frac{1-e^{-2\beta d(Y)}}{1-e^{-2\beta d_0}} = \frac{1}{\cos^2(B\theta)} \tag{E27}$$

By using a formula of a trigonometric function $1+\tan^2(x) = 1/\cos^2(x)$ and introducing Equation (E25) thereto, Equation (E27) can be converted to Equation (E28):

$$\frac{1-e^{-2\beta d(Y)}}{1-e^{-2\beta d_0}} = 1 + \frac{B^2}{K^2}Y^2 \tag{E28}$$

Here, at $Y=Y_{max}$, $d(Y_{max})=d_6$; then, $Y=Y_{max}$ and $d(Y)=d_6$ are introduced to Equation (E28) and converted to obtain Equation (E29):

$$\frac{B^2}{K^2} = \left(\frac{1-e^{-2\beta d_6}}{1-e^{-2\beta d_0}} - 1\right)\frac{1}{Y_{max}^2} \tag{E29}$$

Equation (E29) is introduced to Equation (E28), and is solved for d(Y) to obtain Equation (E30):

$$d(Y) = d_0 - \frac{1}{2\beta}\ln\left[1-(1-e^{-2\beta\Delta})\frac{Y^2}{Y_{max}^2}\right] \tag{E30}$$

where, as described above, Δ is defined as $(d_6-d_0)$. ln(·) represents a natural logarithm function.

The film thickness distribution d(Y) of the charge generating layer represented by Equation (E30) is the exact solution for the film thickness distribution needed to provide a more significantly uniform exposure potential distribution in the axial direction of the photosensitive member in the present disclosure.

Furthermore, the present inventors considered that Equation (E30) is represented by an approximate equation which is established when the values of $Y^2/Y_{max}^2$ and $2\beta\Delta$ are small. Thereby, the shape of the film thickness distribution of the charge generating layer suitable for the present disclosure is more clarified, and actual formation of the film thickness distribution by immersion coating is facilitated. Specifically, using Maclaurin expansion of $\ln(1-x)$ and $e^{-x}$, Equation (E30) is converted to Equation (E31):

$$d(Y) = d_0 + \frac{1}{2\beta}\sum_{n=1}^{\infty}\frac{1}{n}\left[-\frac{Y^2}{Y_{max}^2}\sum_{m=1}^{\infty}\frac{(-2\beta\Delta)^m}{m!}\right]^n \tag{E31}$$

$Y^2/Y_{max}^2$, that is, $Y^4/Y_{max}^4$ and VA are left up to the second term to obtain Equation (E32), which represents a final film thickness distribution of the charge generating layer:

$$d(Y) = d_0 + \Delta(1-\beta\Delta)\frac{Y^2}{Y_{max}^2} + \beta\Delta^2\frac{Y^4}{Y_{max}^4} \tag{E32}$$

Figure 7:
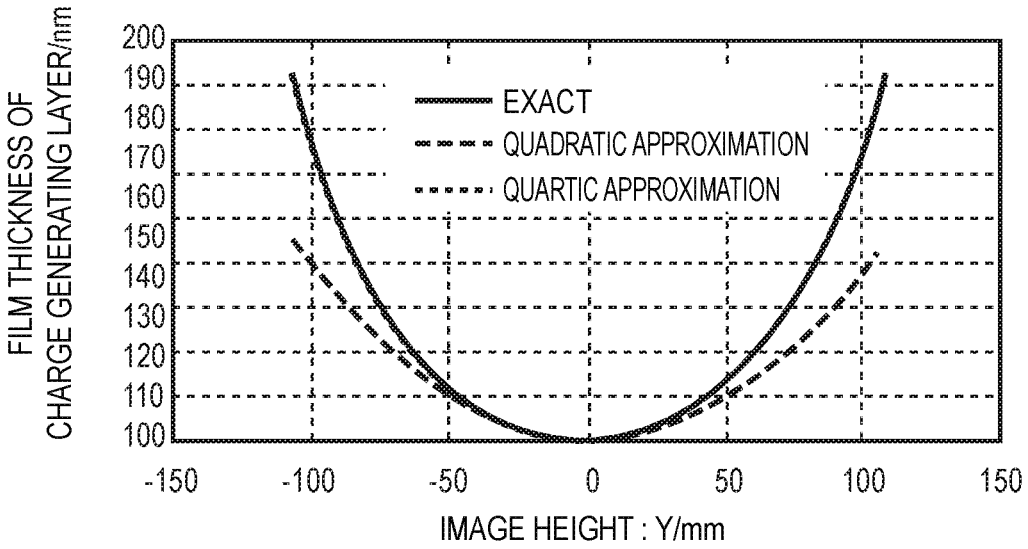
FIG. 7 is a graph showing the film thickness distribution d(Y) of the charge generating layer according to the present disclosure.
Figure 8:
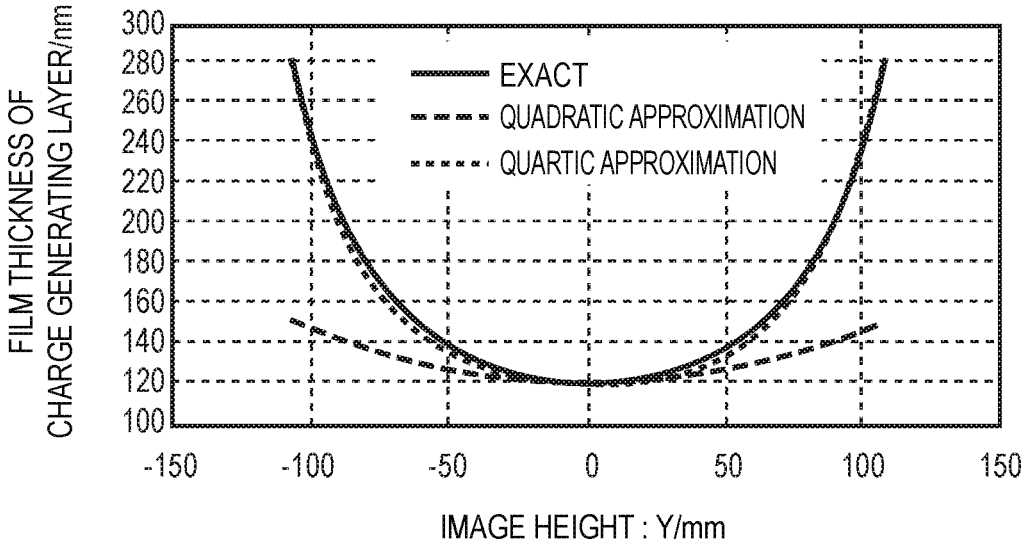
FIG. 8 is the graph showing the film thickness distribution d(Y) of the charge generating layer according to the present disclosure.

FIG. 7 shows the film thickness distribution d(Y) of the charge generating layer, which is calculated where Equation (E30) is defined as the exact solution, Equation (E32) is defined as a quartic approximation, Equation (E32) where the third term in the right side is neglected is defined as a quadratic approximation, the necessary sensitivity ratio r represented by Equation (E20) is 1.35, the absorption coefficient β is 0.00495, $d_0$=100, and $Y_{max}$=108. Apparently from the graph, the quartic approximation matches the exact solution while the quadratic approximation is significantly deviated from the exact solution. It is noted that the value $Y_{max}$=108 [mm] corresponds to half of the length of a short side of a letter-size sheet of paper. In FIG. 8, the film thickness distribution d(Y) of the charge generating layer is shown, which is calculated where the necessary sensitivity ratio r is 1.35, the absorption coefficient β is 0.00495, and $d_0$=120. Also in this case, the deviation of the quartic approximation from the exact solution is small, which reveals that as an equation to represent the film thickness distribution d(Y) of the charge generating layer according to the present disclosure, Equation (E14) is effective for the actual values of physical properties. The charge generating layer can be formed by preparing the coating solution for a charge generating layer containing the materials described above and a solvent, and forming and drying a coating thereof. Examples of the solvent used for the coating solution include alcohol solvents, sulfoxide solvents, ketone solvents, ether solvents, ester solvents, and aromatic hydrocarbon solvents.

To determine the film thickness of the charge generating layer from the state of the electrophotographic photosensitive member, it is sufficient that the charge generating layer in the electrophotographic photosensitive member is extracted by an FIB method, and Slice & View of an FIB-SEM is performed. From SEM cross-sectional image observation by Slice & View in the FIB-SEM, the film thickness of the charge generating layer is obtained. A simpler method can also be used, for example, a method of determining the film thickness of the charge generating layer from its average specific gravity and weight. Another simpler method can also be used, for example, a method of preliminarily obtaining calibration curves of the Macbeth density of the electrophotographic photosensitive member and the film thickness of the charge generating layer, measuring Macbeth densities at points of the photosensitive member, and converting these into film thicknesses.

In the present disclosure, a calibration curve was obtained from the Macbeth density measured by pressing a spectrodensitometer (trade name: X-Rite 504/508, made by X-Rite, Incorporated) against the surface of the photosensitive member and the measured value of the film thickness by the SEM cross-sectional image observation, and the Macbeth densities at points of the photosensitive member were converted using the calibration curve to precisely and simply measure the film thickness distribution of the charge generating layer.

In the present disclosure, absorption coefficients β of charge generating substances were determined as follows. First, an electrophotographic photosensitive member is processed to expose a charge generating layer from the surface thereof. For example, an upper layer of the charge generating layer may be peeled using a solvent or the like. The light reflectance is measured in this state. Subsequently, the charge generating layer is peeled in the same manner as above to measure the light reflectance in the state where a layer underlying the charge generating layer is exposed from the surface thereof. Using the two reflectances thus obtained, the light absorptivity of a single layer of charge generating layer is calculated. On the other hand, the film thickness of the charge generating layer is determined by the method described above. The absorption coefficient is obtained from a slope defined by connecting points of values of natural logarithms of the light absorptivity and the film thickness data obtained by the methods above to those at a value of 0 of the natural logarithm value 0 where the light absorptivity is 100% and at a value of 0 of the film thickness with a straight line.

The phthalocyanine pigment contained in the electrophotographic photosensitive member according to the present disclosure is measured by powder X-ray diffractometry and $^1$H-NMR under the following conditions.

(Powder X-Ray Diffractometry)

Apparatus to be used: made by Rigaku Denki Kabushikigaisha, X-ray diffraction diffractometer RINT-TTRII X-ray tube: Cu X-ray wavelength: Kα1

Tube voltage: 50 KV

Tube current: 300 mA

Scan method: 2θ scan

S rate: 4.0°/min

Sampling interval: 0.02°

Start angle 2θ: 5.0°

Stop angle 2θ: 35.0°

Goniometer: rotor horizontal goniometer (TTR-2)

Attachment: capillary rotary sample stand

Filter: none

Detector: scintillation counter

Incident monochromator: used

Slit: variable slit (parallel beam method)

Counter monochromator: not used

Divergence slit: open

Divergence vertical control slit: 10.00 mm

Scattering slit: open

Receiving slit: open ($^1$H-NMR measurement)

Apparatus used: made by BRUKER Corporation, AVANCEIII 500

Solvent: deuterated sulfuric acid ($D_2SO_4$)

The number of integrations: 2,000

(1-2) Charge Transport Layer

The charge transport layer preferably contains a charge transport substance and a resin.

Examples of the charge transport substance include polycyclic aromatic compounds, heterocyclic compounds, hydrazone compounds, styryl compounds, enamine compounds, benzidine compounds, triarylamine compounds, and resins having groups derived from these substances. Among these, triarylamine compounds and benzidine compounds are preferred.

The content of the charge transport substance in the charge transport layer is preferably 25% by mass or more and 70% by mass or less, more preferably 30% by mass or more and 55% by mass or less relative to the total mass of the charge transport layer.

Examples of the resin include polyester resins, polycarbonate resins, acrylic resins, and polystyrene resins. Among these, polycarbonate resins and polyester resins are preferred. Among the polyester resins, particularly preferred are polyarylate resins.

The content ratio (mass ratio) of the charge transport substance to the resin is preferably 4:10 to 20:10, more preferably 5:10 to 12:10.

The charge transport layer may contain additives such as an antioxidant, an ultraviolet absorbing agent, a plasticizer, a leveling agent, a slip properties imparting agent, and a wear resistance improver. Specifically, examples thereof include hindered phenol compounds, hindered amine compounds, sulfur compounds, phosphorus compounds, benzophenone compounds, siloxane-modified resins, silicone oil, fluorinated resin particles, polystyrene resin particles, polyethylene resin particles, silica particles, alumina particles, and boron nitride particles.

The charge transport layer can be formed by preparing a coating solution for a charge transport layer containing the materials described above and a solvent, and forming and drying a coating thereof. Examples of the solvent used for the coating solution include alcohol solvents, ketone solvents, ether solvents, ester solvents, and aromatic hydrocarbon solvents. Among these solvents, ether solvents or aromatic hydrocarbon solvents are preferred.

The charge transport layer has an average film thickness of preferably 5 μm or more and 50 μm or less, more preferably 8 μm or more and 40 μm or less, particularly preferably 10 μm or more and 30 μm or less.

The film thickness distribution of the charge transport layer according to the present disclosure was measured as follows.

First, a region from the central position of the image formation region to the end position of the image formation region in the axial direction of the cylindrical electrophotographic photosensitive member according to the present disclosure was equally divided into five regions. In the next step, while each of the five regions divided was being rotated in the circumferential direction of the photosensitive member, the region was measured at an interval with a pitch of 1 mm both in the axial direction and in the circumferential direction. The averages of the obtained values were defined as average film thicknesses [μm] of the charge transport layer in the respective regions, and were defined as $D_1$, $D_2$, $D_3$, $D_4$, and $D_5$ in sequence from the central position of the image formation region to the end position of the image formation region.

The film thickness distribution of the charge transport layer satisfies preferably the relations represented by Equations (E33) to (E36), more preferably the relations represented by Equations (E37) to (E40):

$$1.00<D_2/D_1<1.10 \quad \text{(E33)}$$

$$1.01<D_3/D_1<1.25 \quad \text{(E34)}$$

$$1.05<D_4/D_1<1.45 \quad \text{(E35)}$$

$$1.10<D_5/D_1<1.70 \quad \text{(E36)}$$

$$1.00<D_2/D_1<1.08 \quad \text{(E37)}$$

$$1.02<D_3/D_1<1.13 \quad \text{(E38)}$$

$$1.07<D_4/D_1<1.20 \quad \text{(E39)}$$

$$1.15<D_5/D_1<1.35 \quad \text{(E40)}$$

As a result of examination, the present inventors have found that if the relations represented by Equation (E33) to (E36) are satisfied, an unevenness in life of the photosensitive member can be further reduced, and that if the relations represented by Equations (E37) to (E40) are satisfied, the unevenness in life of the photosensitive member can be much further reduced.

In the film thickness distribution of the charge generating layer and that of the charge transport layer, where the average of the average film thicknesses $d_1$, $d_2$, $d_3$, $d_4$, and $d_5$ of the charge generating layer is defined as $d_{ave}$, the average of the average film thicknesses $D_1$, $D_2$, $D_3$, $D_4$, and $D_5$ of the charge transport layer is defined as $D_{ave}$, and $A=D_{ave}/d_{ave}$, it is particularly preferred that $d_1$, $d_2$, $d_3$, $d_4$, $d_5$, $D_1$, $D_2$, $D_3$, $D_4$, and $D_5$ satisfy the relations represented by Equations (E41) to (E45):

$$0.8\,A<D_1/d_1<1.2\,A \quad \text{(E41)}$$

$$0.8\,A<D_2/d_2<1.2\,A \quad \text{(E42)}$$

$$0.8\,A<D_3/d_3<1.2\,A \quad \text{(E43)}$$

$$0.8\,A<D_4/d_4<1.2\,A \quad \text{(E44)}$$

$$0.8\,A<D_5/d_5<1.2\,A \quad \text{(E45)}$$

As described above, the unevenness in life of the photosensitive member is caused because the amount of carriers generated from the charge generating substance is different in the axial direction of the photosensitive member. The carriers generated in the charge generating layer pass through the charge transport layer to cancel out the surface potential of the photosensitive member. The amount discharged during charge increases by the amount cancelled, and the charge transport layer is more significantly damaged. As a result, the amount of the charge transport layer scraped increases. The amount of pre-exposure to cancel out the charged charges is usually uniform in the axial direction of the photosensitive member. For this reason, the amount of the charge transport layer scraped is increased toward the end positions having a large film thickness of the charge generating layer, and thus the life is reduced. Accordingly, the unevenness in life of the photosensitive member in the axial direction can be reduced by increasing the film thickness of the charge transport layer from the central position towards the end positions in the axial direction of the photosensitive member. As a result of examination, the present inventors have revealed that if the relations represented by Equations (E41) to (E45) are satisfied, the film thickness distribution of the charge generating layer synergistically acts with the film thickness distribution of the charge transport layer to reduce an unevenness in the exposure potential distribution of the photosensitive member and more effectively reduce the unevenness in life.

The film thickness of the charge transport layer was measured using a laser interference film thickness meter SI-T80 made by Keyence Corporation. The measurement was performed at an interval with a pitch of 1 mm both in the axial direction and in the circumferential direction such that the photosensitive member was rotated in the circumferential direction while being scanned in the axial direction with a probe facing the photosensitive member. The measured values were averaged for each region defined above to determine the average film thickness of each region.

<Protective Layer>

In the present disclosure, a protective layer may be disposed on the photosensitive layer. A protective layer disposed thereon can improve the durability. Note that if a protective layer is disposed on the photosensitive layer, the film thicknesses $D_1$, $D_2$, $D_3$, $D_4$, and $D_5$ of the charge transport layer each are a film thickness including the thickness of the protective layer. The protective layer preferably contains conductive particles and/or a charge transport substance, and a resin.

Examples of the conductive particles include particles of metal oxides such as titanium oxide, zinc oxide, tin oxide, and indium oxide.

Examples of the charge transport substance include polycyclic aromatic compounds, heterocyclic compounds, hydrazone compounds, styryl compounds, enamine compounds, benzidine compounds, triarylamine compounds, and resins having groups derived from these substances. Among these, triarylamine compounds and benzidine compounds are preferred.

Examples of the resin include polyester resins, acrylic resins, phenoxy resins, polycarbonate resins, polystyrene resins, phenol resins, melamine resins, and epoxy resins. Among these, polycarbonate resins, polyester resins, and acrylic resins are preferred.

The protective layer may be formed a cured film formed by polymerizing a composition containing a monomer having a polymerizable functional group. Examples of the reaction at this time include heat polymerization reaction, photopolymerization reaction, and radiation polymerization reaction. Examples of the polymerizable functional group included in the monomer having a polymerizable functional group include an acrylic group and a methacrylic group. As the monomer having a polymerizable functional group, a material having a charge transport ability may be used.

The protective layer may contain additives such as an antioxidant, an ultraviolet absorbing agent, a plasticizer, a leveling agent, a slip properties imparting agent, and a wear resistance improver. Specifically, examples thereof include hindered phenol compounds, hindered amine compounds, sulfur compounds, phosphorus compounds, benzophenone compounds, siloxane-modified resins, silicone oil, fluorinated resin particles, polystyrene resin particles, polyethylene resin particles, silica particles, alumina particles, and boron nitride particles.

The protective layer has an average film thickness of preferably 0.5 μm or more and 10 μm or less, preferably 1 μm or more and 7 μm or less.

The protective layer can be formed by preparing a coating solution for a protective layer containing the materials described above and a solvent, forming a coating thereof, and drying and/or curing the coating. Examples of the solvent used for the coating solution include alcohol solvents, ketone solvents, ether solvents, sulfoxide solvents, ester solvents, and aromatic hydrocarbon solvents.

EXAMPLES

Hereinafter, the present disclosure will be described more in detail by way of Examples and Comparative Examples. The present disclosure will not be limited by Examples below unless it is beyond the gist thereof. In the description in Examples below, the term "part(s)" is mass-based unless otherwise specified. In the electrophotographic photosensitive members in Examples and Comparative Examples, the film thicknesses of the layers excluding the charge generating layer and the charge transport layer were determined by a method using an eddy current film thickness meter (Fischerscope, made by Fischer Technology, Inc.) or a method of converting a mass per unit area according to the specific gravity. The film thickness of the charge generating layer was precisely and simply measured as follows: A calibration curve was obtained from a Macbeth density measured by pressing a spectrodensitometer (trade name: X-Rite 504/

508, made by X-Rite, Incorporated) against the surface of the photosensitive member and the measured value of the film thickness by cross-sectional SEM image observation; and using the calibration curve, the Macbeth densities at the points of the photosensitive member were converted. The film thickness of the charge transport layer was measured using a laser interference film thickness meter SI-T80 made by Keyence Corporation. Unless otherwise specified, the measurement was performed at an interval with a pitch of 1 mm both in the axial direction and in the circumferential direction such that the photosensitive member was rotated in the circumferential direction while being scanned in the axial direction with a probe facing the photosensitive member. The measured values were averaged for each region defined above to determine the average film thickness of each region.

<Preparation of Coating Solution for Conductive Layer>

Coating solutions for a conductive layer were prepared by the following methods.

(Coating Solution 1 for Conductive Layer)

Anatase titanium dioxide for the core material can be prepared by a known sulfuric acid method. In other words, anatase titanium dioxide is prepared by hydrolyzing a solution containing titanium sulfate and titanyl sulfate by heating to prepare a metatitanic acid slurry, and dehydrating and calcining the metatitanic acid slurry.

Particles of a core material used were anatase titanium oxide particles having an average primary particle diameter of 200 nm. A titanium niobium sulfate solution containing titanium (33.7 parts in terms of $TiO_2$) and niobium (2.9 parts in terms of $Nb_2O_5$) was prepared. 100 parts of particles of a core material was dispersed in pure water to prepare 1000 parts of a suspension, which was heated to 60° C. The titanium niobium sulfate solution and 10 mol/L sodium hydroxide were added dropwise to the suspension over 3 hours such that the pH of the suspension was 2 to 3. After the total amounts thereof were added dropwise, the pH was adjusted to near neutral, and a flocculant was added to sediment solid contents. The supernatant was removed, followed by filtration, washing, and drying at 110° C., yielding an intermediate product containing 0.1 wt % (in terms of C) organic product derived from the flocculant. The intermediate product was calcined in the presence of nitrogen at 750° C. for one hour, and then was calcined in air at 450° C. to prepare Titanium oxide particles 1. The prepared particles had an average particle diameter (average primary particle diameter) of 220 nm, which was measured by a particle diameter measuring method using the scanning electron microscope described above.

In the next step, 80 parts of a phenol resin (monomer/oligomer of a phenol resin) (trade name: Plyophen J-325, made by DIC Corporation, resin solid content: 60%, density after curing: 1.3 g/cm$^2$) as a binding material was dissolved in 60 parts of 1-methoxy-2-propanol as a solvent to prepare a solution.

100 parts of Metal oxide particles 1 was added to the solution. This solution as a dispersion medium was placed into a vertical sand mill containing 200 parts of glass beads having an average particle diameter of 1.0 mm, and was dispersed at a dispersion solution temperature of 23±3° C. and the number of rotations of 1500 rpm (circumferential speed: 5.5 m/s) for 2 hours to prepare a dispersion solution. The glass beads were removed from the dispersion solution using a mesh. The dispersion solution after the removal of the glass beads were filtered under increased pressure using a PTFE filter paper (trade name: PF060, made by Advantec Toyo Kaisha, Ltd.). 0.015 parts of silicone oil (trade name: SH28 PAINT ADDITIVE, made by Dow Corning Toray Co., Ltd.) as a leveling agent and 15 parts of silicone resin particles (trade name: KMP-590, made by Shin-Etsu Chemical Co., Ltd., average particle diameter: 2 μm, density: 1.3 g/cm$^3$) as a surface roughness imparting material were added to the dispersion solution after the filtration under increased pressure, followed by stirring, to prepare Coating solution 1 for a conductive layer.

(Coating Solution 2 for Conductive Layer)

60 parts of barium sulfate particles coated with tin oxide (trade name: Pastran PCl, made by Mitsui Mining & Smelting Co., Ltd.), 15 parts of titanium oxide particles (trade name: TITANIX JR, made by Tayca Corporation), 43 parts of a resol phenol resin (trade name: PHENOLITE J-325, made by DIC Corporation, solid content: 70% by mass), 0.015 parts of silicone oil (trade name: SH28 PA, made by Dow Corning Toray Co., Ltd.), 3.6 parts of silicone resin particles (trade name: Tospearl 120, made by Momentive Performance Materials Japan LLC), 50 parts of 2-methoxy-1-propanol, and 50 parts of methanol were placed into a ball mill, and were dispersed for 20 hours to prepare Coating solution 2 for a conductive layer.

<Preparation of Coating Solution for Charge Generating Layer>

Coating solutions for a charge generating layer were prepared by the following methods.

(Coating Solution 1 for Charge Generating Layer)

10 parts of hydroxygallium phthalocyanine crystals (charge generating substance) having strong peaks at Bragg angles (2θ±0.2°) of 7.5°, 9.9°, 16.3°, 18.6°, 25.1°, and 28.3° in CuKα characteristic X-ray diffraction, 5 parts of poly(vinyl butyral) (trade name: S-LEC BX-1, made by Sekisui Chemical Co., Ltd.), and 250 parts of cyclohexanone were placed into a sand mill containing glass beads having a diameter of 0.8 mm, and were dispersed for a dispersion time of 3 hours. In the next step, 250 parts of ethyl acetate was added to prepare Coating solution 1 for a charge generating layer.

(Coating Solution 2 for Charge Generating Layer)

12 parts of a titanyl phthalocyanine pigment having a strong peak at a Bragg angle of 27.2°±0.3° in CuKα characteristic X-ray diffraction, 10 parts of poly(vinyl butyral) (trade name: S-LEC BX-1, made by Sekisui Chemical Co., Ltd.), 139 parts of cyclohexanone, and 354 parts of glass beads having a diameter of 0.9 mm were dispersed at a cooling water temperature of 18° C. for 4 hours using a sand mill (K-800, made by Igarashi Kikai Seizo (the current Aimex Co., Ltd.), five disks having a diameter of 70 mm). At this time, the dispersion was performed under the condition that the number of rotations of the disk was 1,800 per 1 minute. 326 parts cyclohexanone and 465 parts of ethyl acetate were added to the dispersion solution to prepare Coating solution 2 for a charge generating layer.

(Coating Solution 3 for Charge Generating Layer)

30 parts of a chlorogallium phthalocyanine pigment having a peak at Bragg angles 2θ±0.2° of 7.4°, 16.6°, 25.5°, and 28.3° in an X-ray diffraction spectrum obtained using CuKα radiation, 10 parts of poly(vinyl butyral) (trade name: S-LEC BX-1, made by Sekisui Chemical Co., Ltd.), 253 parts of cyclohexanone, and 643 parts of glass beads having a diameter of 0.9 mm were dispersed at a cooling water temperature of 18° C. for 4 hours using a sand mill (K-800, made by Igarashi Kikai Seizo (the current Aimex Co., Ltd.), five disks having a diameter of 70 mm). At this time, the dispersion was performed under the condition that the number of rotations of the disk was 1,800 per 1 minute. 592 parts of cyclohexanone and 845 parts of ethyl acetate were added to the dispersion solution to prepare Coating solution 3 for a charge generating layer.

(Coating Solution 4 for Charge Generating Layer)

20 parts of a disazo compound represented by Formula (C1), 8 parts of poly(vinyl butyral) (trade name: S-LEC BX-1, made by Sekisui Chemical Co., Ltd.), 177 parts of cyclohexanone, and 482 parts of glass beads having a diameter of 0.9 mm were dispersed at a cooling water temperature of 18° C. for 4 hours using a sand mill (K-800, made by Igarashi Kikai Seizo (the current Aimex Co., Ltd.), five disks having a diameter of 70 mm). At this time, the dispersion was performed under the condition that the number of rotations of the disk was 1,800 per 1 minute. 414 parts of cyclohexanone and 592 parts of ethyl acetate were added to the dispersion solution to prepare Coating solution 4 for a charge generating layer.

(C1)

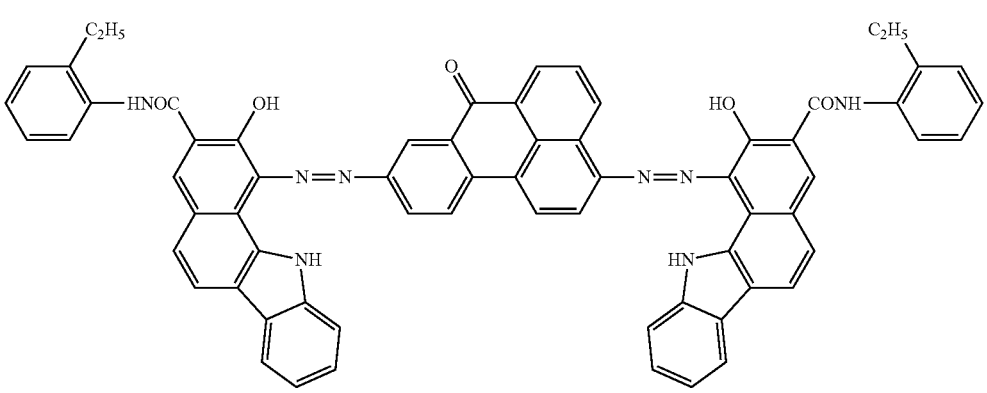

(Coating Solution 5 for Charge Generating Layer)

20 parts of a disazo compound represented by Formula (C2), 8 parts of poly(vinyl butyral) (trade name: S-LEC BX-1, made by Sekisui Chemical Co., Ltd.), 177 parts of cyclohexanone, and 482 parts of glass beads having a diameter of 0.9 mm were dispersed at a cooling water temperature of 18° C. for 4 hours using a sand mill (K-800, made by Igarashi Kikai Seizo (the current Aimex Co., Ltd.), five disks having a diameter of 70 mm). At this time, the dispersion was performed under the condition that the number of rotations of the disk was 1,800 per 1 minute. 414 parts of cyclohexanone and 592 parts of ethyl acetate were added to the dispersion solution to prepare Coating solution 5 for a charge generating layer.

(C2)

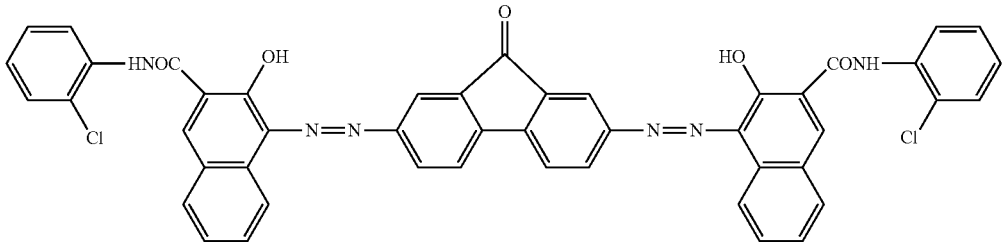

(Coating Solution 6 for Charge Generating Layer)

20 parts of a trisazo compound Represented by Formula (C3), 30 parts of poly(vinyl butyral) (trade name: S-LEC BLS, made by Sekisui Chemical Co., Ltd.), 300 parts of cyclohexanone, and 500 parts of glass beads having a diameter of 0.9 mm were milled at room temperature (23° C.) for 48 hours using a ball mill. At this time, the milling was performed using a standard bottle (product name: PS-6, made by Hakuyo Glass Co., Ltd.) as a container under a condition that the container was rotated at 60 rotations per 1 minute. 60 parts of cyclohexanone and 360 parts of ethyl acetate were added to the dispersion solution to prepare Coating solution 6 for a charge generating layer.

(C3)

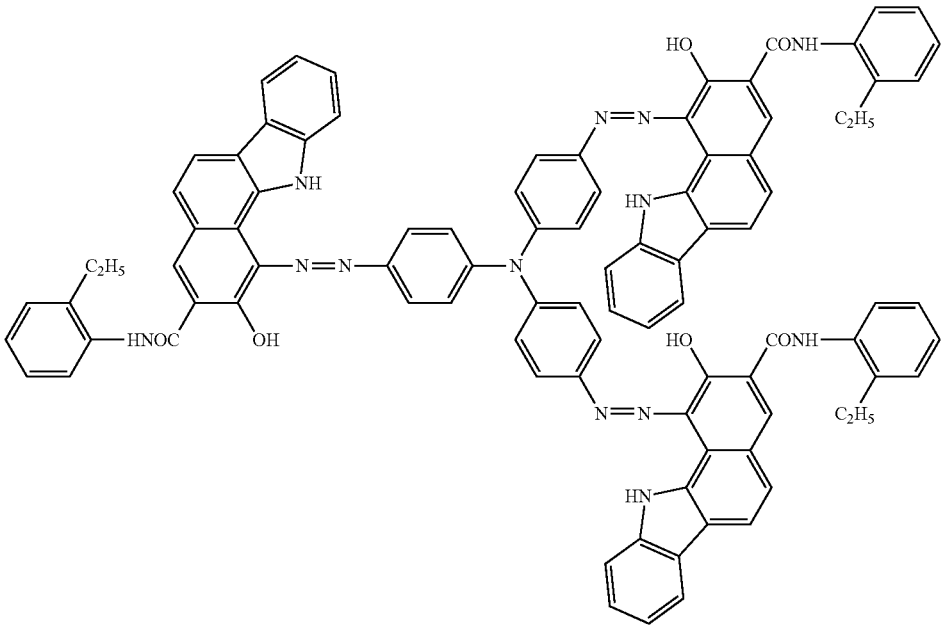

<Preparation of Coating Solution for Charge Transport Layer>

Coating solution for a charge generating layer were prepared by the following methods.

(Coating Solution 1 for Charge Transport Layer)

8 parts of a triarylamine compound represented by Formula (C4) and 10 parts of polyarylate including two repeating structural units represented by Formula (C5) in a proportion of 5/5 and having a weight average molecular weight (Mw) of 100000 were dissolved in a mixed solvent of 40 parts of dimethoxymethane and 60 parts of chlorobenzene to prepare Coating solution 1 for a charge transport layer.

(C4)

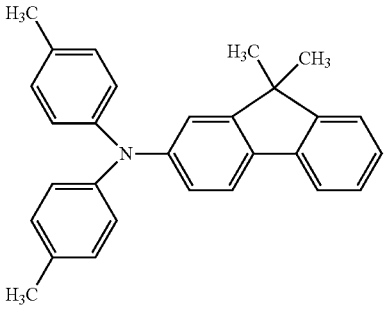

-continued (C-5)

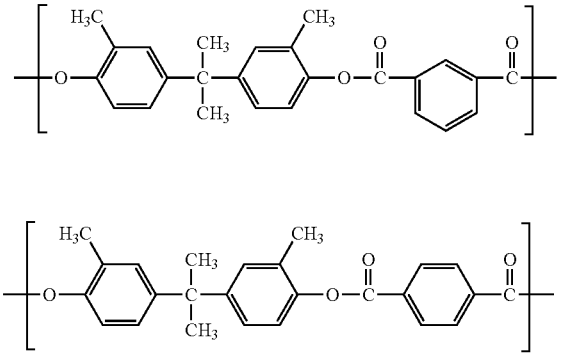

(Coating Solution 2 for Charge Transport Layer)

6 parts of triarylamine compound represented by Formula (C4), and 4 parts of bisphenol Z type polycarbonate (trade name: Z400, made by Mitsubishi Engineering-Plastics Corporation) including two repeating structural units represented by Formula (C5) in a proportion of 5/5 and having a weight average molecular weight (Mw) of 40000, and 0.36 parts of siloxane modified polycarbonate ((B-1):(B-2)=95:5 (molar ratio)) including a repeating structural unit represented by Formula (B-1), a repeating structural unit represented by Formula (B-2), and a terminal structure represented by Formula (B-3) were dissolved in a mixed solvent of o-xylene (60 parts)/dimethoxymethane (40 parts)/methyl benzoate (2.7 parts) to prepare Coating solution 2 for a charge transport layer.

(B-1)

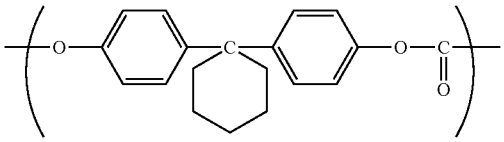

(B-2)

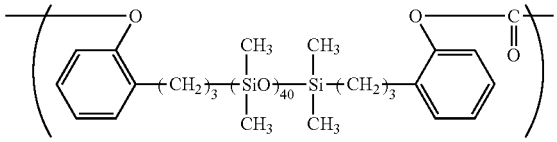

(B-3)

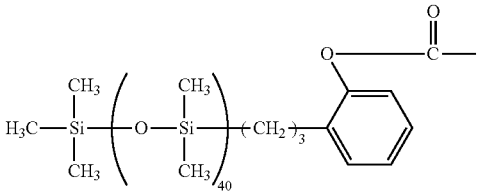

<Preparation of Electrophotographic Photosensitive Member>

(Electrophotographic Photosensitive Member 1)

<Support>

The support used was an aluminum cylinder (JIS-A3003, aluminum alloy) having a length of 257 mm and a diameter of 24 mm and manufactured by a manufacturing method including an extrusion step and a drawing step.

<Conductive Layer>

In the next step, Coating solution 1 for a conductive layer was applied onto the support described above by immersion coating to form a coating, and the coating was cured by heating at 145° C. for 1 hour to form a conductive layer having a film thickness of 25 μm.

<Undercoat Layer>

In the next step, 25 parts of N-methoxymethylated nylon 6 (trade name: TORESIN EF-30T, made by Nagase ChemteX Corporation) was dissolved (dissolved by heating at 65° C.) in 480 parts of a mixed solution of methanol/n-butanol=2/1 to prepare Coating solution 1 for an undercoat layer. Subsequently, the solution was filtered through a membrane filter (trade name: FP-022, opening diameter: 0.22 μm, made by Sumitomo Electric Industries, Ltd.) to prepare a coating solution for an undercoat layer. The coating solution for an undercoat layer thus prepared was applied onto the conductive layer described above by immersion coating to form a coating, and the coating was dried by heating at a temperature of 100° C. for 10 minutes to form an undercoat layer having a film thickness of 0.85 μm.

<Charge Generating Layer>

In the next step, Coating solution 1 for a charge generating layer was applied onto the undercoat layer by immersion coating, and the obtained coating was dried at 100° C. for 10 minutes to form a charge generating layer. The pulling rate during immersion coating was gradually varied as in Table 1 according to the distance from the solution level to the upper end of the support. The film thicknesses of the charge generating layers obtained are shown in Table 3.

TABLE 1

| Distance from upper end of support [mm] | Pulling rate [mm/min] |
|---|---|
| 0 to 3 | 953 |
| 3 to 20 | 926 |
| 20 to 42 | 733 |
| 42 to 63 | 565 |
| 63 to 85 | 429 |
| 85 to 106 | 334 |
| 106 to 128 | 280 |
| 128 to 150 | 280 |
| 150 to 172 | 334 |
| 172 to 194 | 430 |
| 194 to 215 | 566 |
| 215 to 237 | 735 |
| 237 to 254 | 929 |
| 254 to 257 | 960 |

<Charge transport layer>

In the next step, Coating solution 1 for a charge transport layer was applied onto the charge generating layer by immersion coating, and the obtained coating was dried at 120° C. for 40 minutes to form a charge transport layer. The pulling rate during immersion coating was gradually varied as in Table 2 according to the distance from the solution level to the upper end of the support. The film thicknesses of the charge transport layers obtained are shown in Table 4. Table 4 also shows whether the obtained film thicknesses of the charge transport layers and those of the conductive layers satisfy the relations in Evaluation 1 (E33, E34, E35, and E36), Evaluation 2 (E37, E38, E39, and E40), and Evaluation 3 (E41, E42, E43, E44, and E45), respectively. In the results of evaluation, a film thickness satisfying all of the relations represented by the equations in the respective evaluations is ranked as A, and that not satisfying any one of the relations represented by the equations in the respective evaluations is ranked as B.

TABLE 2

| Distance from upper end of support [mm] | Pulling rate [mm/min] |
|---|---|
| 0 to 3 | 160 |
| 3 to 20 | 154 |
| 20 to 42 | 146 |
| 42 to 63 | 142 |
| 63 to 85 | 140 |
| 85 to 106 | 138 |
| 106 to 128 | 136 |
| 128 to 150 | 136 |
| 150 to 172 | 138 |
| 172 to 194 | 140 |
| 194 to 215 | 142 |
| 215 to 237 | 146 |
| 237 to 254 | 154 |
| 254 to 257 | 160 |

The coatings of the conductive layer, the undercoat layer, the charge generating layer, and the charge transport layer were subjected to heat treatment in an oven set at a temperature for a corresponding layer. The heat treatment of the layers was also performed in Production Example of a photosensitive member below in the same manner. Thus, Electrophotographic photosensitive member 1 having a cylindrical (drum-like) shape was prepared.

Table 5 shows the type of the charge generating substance contained in Electrophotographic photosensitive member 1 prepared at this time, the content of Compound (A1) contained in crystals of the charge generating substance, the absorption coefficient β of the charge generating layer measured by the method above, the calculated value of Equation (E46), $\Delta=d_6-d_0$, and the values of the film thicknesses of the charge generating layer in the regions in the axial direction of the support, calculated from Equation (E47). For d=d(Y) calculated from Equation (E47), it was determined whether the distribution of the film thickness of the charge generating layer in Example 1 fell within the range between (d−0.2Δ) and (d+0.2Δ). It was confirmed that in all the regions, the distribution of the film thickness of the charge generating layer in Example 1 fell within the range between (d−0.2Δ) and (d+0.2Δ). The results are also shown in Table 5.

$$\frac{1-e^{-2\beta d_6}}{1-e^{-2\beta d_0}} \geq 1.2 \tag{E46}$$

$$d(Y) = d_0 + \Delta(1-\beta\Delta)\frac{Y^2}{Y_{max}^2} + \beta\Delta^2\frac{Y^4}{Y_{max}^4} \tag{E47}$$

In the table, "HOGaPc" represents "hydroxygallium phthalocyanine pigment", "TiOPc" represents "titanyl phthalocyanine pigment", "ClGaPc" represents "chlorogallium phthalocyanine pigment", "Disazo (C1)" represents "compound represented by Formula (C1)", "disazo (C2)" represents "compound represented by Formula (C2)", and "Trisazo" represents "compound represented by Formula (C3)".

(Electrophotographic photosensitive members 2 to 40)

Figure 9:
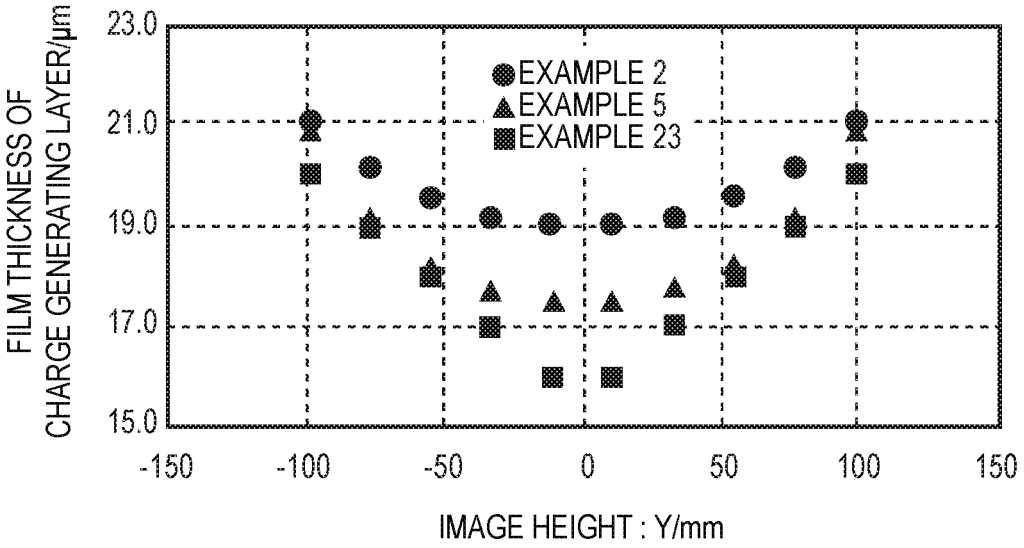
FIG. 9 is a graph illustrating the film thickness of the charge transport layer distributions of Examples 2, 5, and 23.

Electrophotographic photosensitive members 2 to 40 were prepared in the same manner as in Electrophotographic photosensitive member 1 except that the film thickness of the charge generating layer, the film thickness of the charge transport layer, the film thickness of the conductive layer, Coating solution 1 for a conductive layer, Coating solution 1 for a charge generating layer, and Coating solution 1 for a charge transport layer in Electrophotographic photosensitive member 1 were varied and the solid contents in the coating solution for a charge generating layer and the coating solution for a charge transport layer were varied so as to be applied into a desired film thickness. Table 3 shows the obtained film thickness of the charge generating layer and the coating solution for a charge generating layer, and Table 4 shows the film thickness of the charge transport layer, the film thickness of the conductive layer, the coating solution for a conductive layer, and the coating solution for a charge transport layer. FIG. 9 shows the film thickness distributions of the charge transport layers in Examples 2, 5, and 23.

COMPARATIVE EXAMPLES (Electrophotographic Photosensitive Members 41 to 48)

Electrophotographic photosensitive members 41 to 48 were prepared in the same manner as in Electrophotographic photosensitive member 1 except that the film thickness of the charge generating layer, the film thickness of the charge transport layer, the film thickness of the conductive layer, Coating solution 1 for a conductive layer, and Coating solution 1 for a charge generating layer in Electrophotographic photosensitive member 1 were varied. Table 4 shows the obtained film thickness of the charge generating layer, the film thickness of the charge transport layer, the film thickness of the conductive layer, the coating solution for a conductive layer, and the coating solution for a charge generating layer.

TABLE 3

| Example No. | Electrophotographic photosensitive member | d1 (nm) | d2 (nm) | d3 (nm) | d4 (nm) | d5 (nm) | d0 (nm) | d6 (nm) | Coating solution for charge generating layer No. |
|---|---|---|---|---|---|---|---|---|---|
| Example 1 | Electrophotographic photosensitive member 1 | 100.8 | 107.2 | 121.0 | 144.9 | 185.4 | 100.0 | 217.1 | 1 |
| Example 2 | Electrophotographic photosensitive member 2 | 100.8 | 107.2 | 121.0 | 144.9 | 185.4 | 100.0 | 217.1 | 1 |
| Example 3 | Electrophotographic photosensitive member 3 | 100.8 | 107.2 | 121.0 | 144.9 | 185.4 | 100.0 | 217.1 | 1 |
| Example 4 | Electrophotographic photosensitive member 4 | 140.5 | 144.8 | 153.8 | 168.5 | 191.0 | 140.0 | 206.5 | 1 |
| Example 5 | Electrophotographic photosensitive member 5 | 140.5 | 144.8 | 153.8 | 168.5 | 191.0 | 140.0 | 206.5 | 1 |
| Example 6 | Electrophotographic photosensitive member 6 | 140.5 | 144.8 | 153.8 | 168.5 | 191.0 | 140.0 | 206.5 | 1 |
| Example 7 | Electrophotographic photosensitive member 7 | 200.3 | 202.5 | 207.2 | 214.5 | 224.9 | 200.0 | 231.5 | 1 |
| Example 8 | Electrophotographic photosensitive member 8 | 200.3 | 202.5 | 207.2 | 214.5 | 224.9 | 200.0 | 231.5 | 1 |
| Example 9 | Electrophotographic photosensitive member 9 | 200.3 | 202.5 | 207.2 | 214.5 | 224.9 | 200.0 | 231.5 | 1 |
| Example 10 | Electrophotographic photosensitive member 10 | 240.4 | 243.7 | 250.6 | 261.7 | 278.0 | 240.0 | 288.7 | 1 |
| Example 11 | Electrophotographic photosensitive member 11 | 112.0 | 136.0 | 160.0 | 184.0 | 208.0 | 100.0 | 220.0 | 1 |
| Example 12 | Electrophotographic photosensitive member 12 | 104.0 | 112.0 | 120.0 | 128.0 | 136.0 | 100.0 | 140.0 | 1 |
| Example 13 | Electrophotographic photosensitive member 13 | 100.6 | 105.7 | 116.7 | 136.3 | 171.0 | 100.0 | 200.2 | 2 |
| Example 14 | Electrophotographic photosensitive member 14 | 100.6 | 105.7 | 116.7 | 136.3 | 171.0 | 100.0 | 200.2 | 2 |
| Example 15 | Electrophotographic photosensitive member 15 | 100.6 | 105.7 | 116.7 | 136.3 | 171.0 | 100.0 | 200.2 | 2 |
| Example 16 | Electrophotographic photosensitive member 16 | 140.7 | 146.4 | 159.0 | 181.9 | 225.2 | 140.0 | 265.6 | 2 |
| Example 17 | Electrophotographic photosensitive member 17 | 140.7 | 146.4 | 159.0 | 181.9 | 225.2 | 140.0 | 265.6 | 2 |
| Example 18 | Electrophotographic photosensitive member 18 | 140.7 | 146.4 | 159.0 | 181.9 | 225.2 | 140.0 | 265.6 | 2 |
| Example 19 | Electrophotographic photosensitive member 19 | 200.4 | 203.9 | 211.3 | 223.7 | 243.2 | 200.0 | 257.1 | 2 |

TABLE 3-continued

| Example No. | Electrophotographic photosensitive member | d1 (nm) | d2 (nm) | d3 (nm) | d4 (nm) | d5 (nm) | d0 (nm) | d6 (nm) | Coating solution for charge generating layer No. |
|---|---|---|---|---|---|---|---|---|---|
| Example 20 | Electrophotographic photosensitive member 20 | 200.4 | 203.9 | 211.3 | 223.7 | 243.2 | 200.0 | 257.1 | 2 |
| Example 21 | Electrophotographic photosensitive member 21 | 200.4 | 203.9 | 211.3 | 223.7 | 243.2 | 200.0 | 257.1 | 2 |
| Example 22 | Electrophotographic photosensitive member 22 | 240.7 | 246.4 | 259.0 | 281.8 | 325.0 | 240.0 | 365.2 | 2 |
| Example 23 | Electrophotographic photosensitive member 23 | 100.8 | 107.2 | 121.0 | 144.9 | 185.4 | 100.0 | 217.1 | 3 |
| Example 24 | Electrophotographic photosensitive member 24 | 140.7 | 146.4 | 159.0 | 181.9 | 225.2 | 140.0 | 265.6 | 3 |
| Example 25 | Electrophotographic photosensitive member 25 | 100.7 | 106.0 | 117.8 | 138.9 | 177.5 | 100.0 | 211.5 | 3 |
| Example 26 | Electrophotographic photosensitive member 26 | 140.7 | 146.4 | 159.0 | 181.9 | 225.2 | 140.0 | 265.6 | 3 |
| Example 27 | Electrophotographic photosensitive member 27 | 100.8 | 107.9 | 123.4 | 151.7 | 206.0 | 100.0 | 258.1 | 3 |
| Example 28 | Electrophotographic photosensitive member 28 | 100.8 | 107.9 | 123.4 | 151.7 | 206.0 | 100.0 | 258.1 | 3 |
| Example 29 | Electrophotographic photosensitive member 29 | 100.8 | 107.9 | 123.4 | 151.7 | 206.0 | 100.0 | 258.1 | 3 |
| Example 30 | Electrophotographic photosensitive member 30 | 140.6 | 145.4 | 155.8 | 173.4 | 202.4 | 140.0 | 224.0 | 3 |
| Example 31 | Electrophotographic photosensitive member 31 | 140.6 | 145.4 | 155.8 | 173.4 | 202.4 | 140.0 | 224.0 | 3 |
| Example 32 | Electrophotographic photosensitive member 32 | 100.6 | 105.4 | 115.1 | 130.3 | 151.4 | 100.0 | 164.5 | 4 |
| Example 33 | Electrophotographic photosensitive member 33 | 100.6 | 105.4 | 115.1 | 130.3 | 151.4 | 100.0 | 164.5 | 4 |
| Example 34 | Electrophotographic photosensitive member 34 | 100.6 | 105.4 | 115.1 | 130.3 | 151.4 | 100.0 | 164.5 | 4 |
| Example 35 | Electrophotographic photosensitive member 35 | 140.4 | 143.2 | 149.0 | 157.8 | 169.9 | 140.0 | 177.2 | 5 |
| Example 36 | Electrophotographic photosensitive member 36 | 140.4 | 143.2 | 149.0 | 157.8 | 169.9 | 140.0 | 177.2 | 5 |
| Example 37 | Electrophotographic photosensitive member 37 | 201.3 | 211.6 | 233.0 | 266.9 | 316.1 | 200.0 | 347.7 | 6 |
| Example 38 | Electrophotographic photosensitive member 38 | 201.3 | 211.6 | 233.0 | 266.9 | 316.1 | 200.0 | 347.7 | 6 |
| Example 39 | Electrophotographic photosensitive member 39 | 200.5 | 204.7 | 213.1 | 226.0 | 243.7 | 200.0 | 254.5 | 6 |
| Example 40 | Electrophotographic photosensitive member 40 | 140.3 | 143.1 | 148.6 | 156.9 | 168.3 | 140.0 | 175.1 | 6 |
| Comparative Example 1 | Electrophotographic photosensitive member 41 | 140.0 | 140.0 | 140.0 | 140.0 | 140.0 | 140.0 | 140.0 | 1 |
| Comparative Example 2 | Electrophotographic photosensitive member 42 | 140.0 | 145.0 | 155.0 | 170.0 | 190.0 | 138.0 | 202.5 | 1 |
| Comparative Example 3 | Electrophotographic photosensitive member 43 | 140.0 | 140.0 | 140.0 | 140.0 | 140.0 | 140.0 | 140.0 | 1 |
| Comparative Example 4 | Electrophotographic photosensitive member 44 | 145.0 | 155.0 | 175.0 | 205.0 | 245.0 | 140.0 | 270.0 | 2 |
| Comparative Example 5 | Electrophotographic photosensitive member 45 | 142.0 | 150.0 | 166.0 | 190.0 | 222.0 | 140.0 | 242.0 | 3 |
| Comparative Example 6 | Electrophotographic photosensitive member 46 | 140.0 | 145.0 | 155.0 | 170.0 | 190.0 | 138.0 | 202.5 | 4 |
| Comparative Example 7 | Electrophotographic photosensitive member 47 | 140.0 | 145.0 | 155.0 | 170.0 | 190.0 | 138.0 | 202.5 | 5 |
| Comparative Example 8 | Electrophotographic photosensitive member 48 | 140.0 | 145.0 | 155.0 | 170.0 | 190.0 | 138.0 | 202.5 | 6 |

TABLE 4

| Example No. | D1 (μm) | D2 (μm) | D3 (μm) | D4 (μm) | D5 (μm) | Evaluation (1) | Evaluation (2) | Evaluation (3) | Coating solution for charge transport layer | Film thickness of conductive layer (μm) | Coating solution for conductive layer |
|---|---|---|---|---|---|---|---|---|---|---|---|
| Example 1 | 8.8 | 8.9 | 9.0 | 9.1 | 9.3 | B | B | B | 1 | 25 | 1 |
| Example 2 | 17.5 | 17.7 | 18.3 | 19.2 | 20.8 | A | A | B | 1 | 25 | 1 |
| Example 3 | 45.8 | 46.8 | 49.0 | 52.8 | 59.1 | A | A | A | 1 | 25 | 1 |
| Example 4 | 9.0 | 9.1 | 9.2 | 9.3 | 9.4 | B | B | A | 1 | 25 | 1 |
| Example 5 | 19.0 | 19.2 | 19.5 | 20.1 | 21.0 | A | B | A | 1 | 25 | 1 |
| Example 6 | 41.1 | 41.6 | 42.6 | 44.4 | 47.0 | A | B | A | 1 | 25 | 1 |
| Example 7 | 9.1 | 9.2 | 9.3 | 9.4 | 9.5 | B | B | A | 1 | 25 | 1 |
| Example 8 | 21.4 | 21.5 | 21.6 | 21.9 | 22.3 | B | B | A | 1 | 25 | 1 |

TABLE 4-continued

| Example No. | D1 (μm) | D2 (μm) | D3 (μm) | D4 (μm) | D5 (μm) | Evaluation (1) | Evaluation (2) | Evaluation (3) | Coating solution for charge transport layer | Film thickness of conductive layer (μm) | Coating solution for conductive layer |
|---|---|---|---|---|---|---|---|---|---|---|---|
| Example 9 | 48.1 | 48.4 | 48.9 | 49.8 | 51.0 | B | B | A | 1 | 25 | 1 |
| Example 10 | 22.9 | 23.1 | 23.3 | 23.8 | 24.4 | B | B | A | 1 | 8 | 2 |
| Example 11 | 20.0 | 22.5 | 25.0 | 27.5 | 30.0 | B | B | A | 1 | 25 | 1 |
| Example 12 | 17.5 | 17.7 | 18.3 | 19.2 | 20.8 | A | A | A | 1 | 25 | 1 |
| Example 13 | 8.8 | 8.9 | 9.0 | 9.1 | 9.2 | B | B | B | 1 | 25 | 1 |
| Example 14 | 17.5 | 17.7 | 18.1 | 18.9 | 20.2 | A | A | B | 1 | 25 | 1 |
| Example 15 | 36.4 | 37.0 | 38.3 | 40.6 | 44.7 | A | A | A | 1 | 25 | 1 |
| Example 16 | 9.0 | 9.1 | 9.2 | 9.3 | 9.4 | B | B | B | 1 | 25 | 1 |
| Example 17 | 19.0 | 19.3 | 19.7 | 20.6 | 22.3 | A | A | A | 1 | 25 | 1 |
| Example 18 | 41.1 | 41.8 | 43.2 | 45.9 | 51.0 | A | A | A | 1 | 25 | 1 |
| Example 19 | 9.2 | 9.3 | 9.4 | 9.5 | 9.6 | B | B | A | 1 | 25 | 1 |
| Example 20 | 21.4 | 21.5 | 21.8 | 22.3 | 23.1 | B | B | A | 1 | 25 | 1 |
| Example 21 | 48.1 | 48.5 | 49.4 | 50.9 | 53.2 | A | B | A | 1 | 25 | 1 |
| Example 22 | 52.9 | 53.5 | 55.0 | 57.7 | 62.8 | A | A | A | 1 | 25 | 1 |
| Example 23 | 16.0 | 17.0 | 18.0 | 19.0 | 20.0 | A | A | B | 1 | 8 | 2 |
| Example 24 | 19.0 | 19.3 | 19.7 | 20.6 | 22.3 | A | A | A | 1 | 8 | 1 |
| Example 25 | 19.0 | 19.1 | 19.4 | 20.0 | 21.0 | A | B | B | 2 | 25 | 1 |
| Example 26 | 28.0 | 28.3 | 28.8 | 29.8 | 31.7 | A | B | A | 2 | 25 | 1 |
| Example 27 | 8.8 | 8.9 | 9.0 | 9.1 | 9.4 | B | B | B | 1 | 25 | 1 |
| Example 28 | 17.5 | 17.7 | 18.3 | 19.5 | 21.6 | A | A | B | 1 | 25 | 1 |
| Example 29 | 36.4 | 37.2 | 39.0 | 42.4 | 48.8 | A | A | B | 1 | 25 | 1 |
| Example 30 | 9.0 | 9.1 | 9.2 | 9.3 | 9.4 | B | B | A | 1 | 25 | 1 |
| Example 31 | 19.0 | 19.2 | 19.6 | 20.3 | 21.5 | A | B | A | 1 | 25 | 1 |
| Example 32 | 8.8 | 8.9 | 9.0 | 9.1 | 9.2 | B | B | B | 1 | 25 | 1 |
| Example 33 | 17.5 | 17.6 | 18.0 | 18.6 | 19.4 | A | B | A | 1 | 25 | 1 |
| Example 34 | 36.4 | 36.9 | 38.1 | 39.9 | 42.3 | A | A | A | 1 | 25 | 1 |
| Example 35 | 19.0 | 19.1 | 19.4 | 19.7 | 20.2 | B | B | A | 1 | 25 | 1 |
| Example 36 | 19.0 | 19.1 | 19.4 | 19.7 | 20.2 | B | B | A | 1 | 8 | 2 |
| Example 37 | 9.3 | 9.4 | 9.5 | 9.6 | 9.8 | B | B | B | 1 | 8 | 2 |
| Example 38 | 21.4 | 21.8 | 22.7 | 24.0 | 25.9 | A | A | A | 1 | 25 | 1 |
| Example 39 | 48.1 | 48.6 | 49.6 | 51.1 | 53.2 | A | B | A | 1 | 25 | 1 |
| Example 40 | 20.0 | 20.1 | 20.2 | 20.4 | 20.7 | B | B | A | 2 | 25 | 1 |
| Comparative Example 1 | 22.0 | 22.5 | 23.5 | 25.0 | 28.0 | A | A | A | 1 | 25 | 1 |
| Comparative Example 2 | 22.0 | 22.0 | 22.0 | 22.0 | 22.0 | B | B | A | 1 | 25 | 1 |
| Comparative Example 3 | 22.0 | 22.0 | 22.0 | 22.0 | 22.0 | B | B | A | 1 | 25 | 1 |
| Comparative Example 4 | 22.0 | 22.0 | 22.0 | 22.0 | 22.0 | B | B | B | 1 | 25 | 1 |
| Comparative Example 5 | 22.0 | 22.0 | 22.0 | 22.0 | 22.0 | B | B | B | 1 | 25 | 1 |
| Comparative Example 6 | 22.0 | 22.0 | 22.0 | 22.0 | 22.0 | B | B | A | 1 | 25 | 1 |
| Comparative Example 7 | 22.0 | 22.0 | 22.0 | 22.0 | 22.0 | B | B | A | 1 | 25 | 1 |
| Comparative Example 8 | 22.0 | 22.0 | 22.0 | 22.0 | 22.0 | B | B | A | 1 | 25 | 1 |

TABLE 5

| Example No. | Type of charge generating substance | Absorption coefficient β [$nm^{-1}$] | Calculated value of Equation (E46) | Δ = $d_6$-$d_0$ [nm] | Y = 10.8 mm | Y = 32.4 mm | Y = 54 mm | Y = 75.6 mm | Y = 97.2 mm |
|---|---|---|---|---|---|---|---|---|---|
| | | | | | Values of film thicknesses of charge generating layer in regions, calculated from Equation (E47) [nm] | | | | |
| Example 1 | HOGaPc | 0.0038 | 1.52 | 117 | 100.7 | 106.3 | 119.5 | 144.4 | 186.8 |
| Example 2 | HOGaPc | 0.0038 | 1.52 | 117 | 100.7 | 106.3 | 119.5 | 144.4 | 186.8 |
| Example 3 | HOGaPc | 0.0038 | 1.52 | 117 | 100.7 | 106.3 | 119.5 | 144.4 | 186.8 |
| Example 4 | HOGaPc | 0.0038 | 1.21 | 67 | 140.5 | 144.6 | 153.5 | 168.4 | 191.3 |
| Example 5 | HOGaPc | 0.0038 | 1.21 | 67 | 140.5 | 144.6 | 153.5 | 168.4 | 191.3 |
| Example 6 | HOGaPc | 0.0038 | 1.21 | 67 | 140.5 | 144.6 | 153.5 | 168.4 | 191.3 |
| Example 7 | HOGaPc | 0.0038 | 1.06 | 32 | 200.3 | 202.5 | 207.2 | 214.5 | 225.0 |
| Example 8 | HOGaPc | 0.0038 | 1.06 | 32 | 200.3 | 202.5 | 207.2 | 214.5 | 225.0 |
| Example 9 | HOGaPc | 0.0038 | 1.06 | 32 | 200.3 | 202.5 | 207.2 | 214.5 | 225.0 |
| Example 10 | HOGaPc | 0.0038 | 1.06 | 49 | 240.4 | 243.6 | 250.5 | 261.6 | 278.1 |
| Example 11 | HOGaPc | 0.0038 | 1.53 | 120 | 100.7 | 106.3 | 119.7 | 145.1 | 188.8 |
| Example 12 | HOGaPc | 0.0038 | 1.23 | 40 | 100.3 | 103.1 | 108.9 | 118.1 | 131.5 |
| Example 13 | TiOPc | 0.0055 | 1.33 | 100 | 100.5 | 104.5 | 114.7 | 135.3 | 172.7 |
| Example 14 | TiOPc | 0.0055 | 1.33 | 100 | 100.5 | 104.5 | 114.7 | 135.3 | 172.7 |
| Example 15 | TiOPc | 0.0055 | 1.33 | 100 | 100.5 | 104.5 | 114.7 | 135.3 | 172.7 |
| Example 16 | TiOPc | 0.0055 | 1.20 | 126 | 140.4 | 144.2 | 155.1 | 179.9 | 228.4 |
| Example 17 | TiOPc | 0.0055 | 1.20 | 126 | 140.4 | 144.2 | 155.1 | 179.9 | 228.4 |
| Example 18 | TiOPc | 0.0055 | 1.20 | 126 | 140.4 | 144.2 | 155.1 | 179.9 | 228.4 |
| Example 19 | TiOPc | 0.0055 | 1.06 | 57 | 200.4 | 203.7 | 210.9 | 223.5 | 243.5 |
| Example 20 | TiOPc | 0.0055 | 1.06 | 57 | 200.4 | 203.7 | 210.9 | 223.5 | 243.5 |
| Example 21 | TiOPc | 0.0055 | 1.06 | 57 | 200.4 | 203.7 | 210.9 | 223.5 | 243.5 |

TABLE 5-continued

| Example No. | Type of charge generating substance | Absorption coefficient β [nm$^{-1}$] | Calculated value of Equation (E46) | Δ = $d_6$-$d_0$ [nm] | Y = 10.8 mm | Y = 32.4 mm | Y = 54 mm | Y = 75.6 mm | Y = 97.2 mm |
|---|---|---|---|---|---|---|---|---|---|
| | | | | | Values of film thicknesses of charge generating layer in regions, calculated from Equation (E47) [nm] | | | | |
| Example 22 | TiOPc | 0.0055 | 1.06 | 125 | 240.4 | 244.2 | 255.1 | 279.8 | 328.2 |
| Example 23 | TiOPc | 0.0055 | 1.36 | 117 | 100.4 | 104.4 | 115.1 | 138.5 | 183.3 |
| Example 24 | TiOPc | 0.0055 | 1.20 | 126 | 140.4 | 144.2 | 155.1 | 179.9 | 228.4 |
| Example 25 | TiOPc | 0.0055 | 1.35 | 112 | 100.4 | 104.4 | 115.1 | 137.5 | 179.8 |
| Example 26 | TiOPc | 0.0055 | 1.20 | 126 | 140.4 | 144.2 | 155.1 | 179.9 | 228.4 |
| Example 27 | ClGaPc | 0.0045 | 1.52 | 158 | 100.5 | 105.0 | 118.4 | 149.4 | 210.8 |
| Example 28 | ClGaPc | 0.0045 | 1.52 | 158 | 100.5 | 105.0 | 118.4 | 149.4 | 210.8 |
| Example 29 | ClGaPc | 0.0045 | 1.52 | 158 | 100.5 | 105.0 | 118.4 | 149.4 | 210.8 |
| Example 30 | ClGaPc | 0.0045 | 1.21 | 84 | 140.5 | 145.0 | 155.0 | 173.2 | 203.1 |
| Example 31 | ClGaPc | 0.0045 | 1.21 | 84 | 140.5 | 145.0 | 155.0 | 173.2 | 203.1 |
| Example 32 | Disazo (C1) | 0.0013 | 1.52 | 65 | 100.6 | 105.4 | 115.1 | 130.3 | 151.4 |
| Example 33 | Disazo (C1) | 0.0013 | 1.52 | 65 | 100.6 | 105.4 | 115.1 | 130.3 | 151.4 |
| Example 34 | Disazo (Cl) | 0.0013 | 1.52 | 65 | 100.6 | 105.4 | 115.1 | 130.3 | 151.4 |
| Example 35 | Disazo (C2) | 0.0015 | 1.20 | 37 | 140.4 | 143.2 | 148.9 | 157.7 | 169.8 |
| Example 36 | Disazo (C2) | 0.0015 | 1.20 | 37 | 140.4 | 143.2 | 148.9 | 157.7 | 169.8 |
| Example 37 | Trisazo (C3) | 0.0010 | 1.52 | 148 | 201.3 | 211.5 | 232.8 | 266.9 | 316.3 |
| Example 38 | Trisazo (C3) | 0.0010 | 1.52 | 148 | 201.3 | 211.5 | 232.8 | 266.9 | 316.3 |
| Example 39 | Trisazo (C3) | 0.0010 | 1.21 | 55 | 200.5 | 204.7 | 213.1 | 226.0 | 243.7 |
| Example 40 | Trisazo (C3) | 0.0010 | 1.21 | 35 | 140.3 | 143.1 | 148.6 | 156.9 | 168.3 |
| Comparative Example 1 | HOGaPc | 0.0038 | 1.00 | 0 | 140.0 | 140.0 | 140.0 | 140.0 | 140.0 |
| Comparative Example 2 | HOGaPc | 0.0038 | 1.21 | 65 | 138.5 | 142.5 | 151.2 | 165.7 | 187.8 |
| Comparative Example 3 | HOGaPc | 0.0038 | 1.00 | 0 | 140.0 | 140.0 | 140.0 | 140.0 | 140.0 |
| Comparative Example 4 | HOGaPc | 0.0055 | 1.21 | 130 | 140.4 | 144.1 | 155.1 | 180.5 | 231.0 |
| Comparative Example 5 | HOGaPc | 0.0045 | 1.24 | 102 | 140.6 | 145.3 | 156.7 | 178.3 | 215.4 |
| Comparative Example 6 | HOGaPc | 0.0013 | 1.36 | 65 | 138.6 | 143.4 | 153.1 | 168.3 | 189.4 |
| Comparative Example 7 | HOGaPc | 0.0015 | 1.34 | 65 | 138.6 | 143.3 | 153.0 | 168.0 | 189.3 |
| Comparative Example 8 | HOGaPc | 0.0010 | 1.38 | 65 | 138.6 | 143.5 | 153.3 | 168.6 | 189.6 |

[Evaluations]

The electrophotographic photosensitive members prepared above were evaluated as follows. The results are shown in Table 6.

The electrophotographic apparatus used and the evaluations of electrophotographic properties will now be described in detail.

<Apparatus for Evaluation>

First, five laser beam printers (trade name: Color Laser Jet CP3525dn) made by Hewlett-Packard Company were prepared as an electrophotographic apparatus for evaluation, and were modified as follows and used.

The optical systems in the five laser beam printers were modified to provide combinations of the scanning characteristics coefficient B in Equation (E8):

$$\theta_{max} = \frac{1}{B}\arccos\sqrt{r} \tag{E8}$$

and the geometric characteristic $\theta_{max}$ of the laser scan unit, that is, (B=0.55, $\theta_{max}$=25°), (B=0.55, $\theta_{max}$=35°), (B=0.55, $\theta_{max}$=45°), (B=0.55, $\theta_{max}$=55°), and (B=0.55, $\theta_{max}$=65°), respectively.

The pre-exposure condition, the charge condition, and the amount of laser exposure were varied to operate the printers. Each of the electrophotographic photosensitive members prepared above was mounted on a magenta process cartridge, and then was mounted on the station for the magenta process cartridge. The laser beam printers were modified to operate without the process cartridges for other colors (cyan, yellow, and black) being mounted on the laser beam printer body.

In output of images, only the magenta process cartridge was mounted on the laser beam printer body to output a monochromatic image of only the magenta toner.

<Evaluation of Unevenness in Distribution of Post-Exposure Potential>

The unevenness in distribution of the post-exposure potential of the electrophotographic photosensitive member was evaluated as follows.

First, each of the electrophotographic photosensitive members prepared was mounted onto the five laser beam printers above under an environment at normal temperature and normal humidity (temperature: 23° C., relative humidity: 50%), and the charger and the amount of exposure were set such that the charge potential at the central position of the image formation region of the electrophotographic photosensitive member was −550 V and the bright potential was −120 V. The amount of pre-exposure was set to be 10 times the amount of exposure. The surface potential of the electrophotographic photosensitive member was set and measured using a process cartridge having a potential probe (trade name: model 344, made by Trek Japan K.K.) attached to the developing position.

Table 6 shows the results of evaluation of the unevenness in distribution of the post-exposure potential performed on Electrophotographic photosensitive members 1 to 44 where each electrophotographic photosensitive member was mounted on the electrophotographic apparatuses and evaluation was performed in one or more settings of the charge potential. In the evaluation, among the results of the five laser beam printers on which the electrophotographic photosensitive member was mounted, the smallest unevenness in distribution of the post-exposure potential was defined as the unevenness in distribution of the post-exposure potential of the electrophotographic photosensitive member. If the unevenness in distribution of the post-exposure potential was smaller than 15.0 V, it was determined that the effects of the present disclosure were obtained. The electrophotographic apparatus used at this time was defined as an optimal modified printer.

In Examples and Comparative Examples in Tables 3, 4, 5, and 6, "Production Example No. of photosensitive member" indicates the electrophotographic photosensitive member used in the evaluation. The unevenness in distribution of the post-exposure potential indicates a difference between the maximum value and the minimum value of the surface potential measured in the image formation region of the photosensitive member with an interval at a pitch of 1 mm both in the axial direction and in the circumferential direction. In the present disclosure, the value of the unevenness in distribution of the post-exposure potential was ranked according to the following criteria. The criteria for evaluation A to D mean that the effects of the present disclosure are demonstrated.

A: 0.0 to 14.9V
B: 15.0 to 29.9 V
C: 30.0 to 44.9 V
D: 45.0 to 59.9 V
E: 60.0 V or higher <Evaluation of Unevenness in Life>

The unevenness in life of the electrophotographic photosensitive member was evaluated as the life ratio as follows. First, in Electrophotographic photosensitive members 1 to 44, the film thickness Do in the central position of the charge transport layer in the electrophotographic photosensitive member was measured under an environment at normal temperature and normal humidity (temperature: 23° C., relative humidity: 50%). The film thickness Do indicates an average film thickness when the film thickness of a region was measured at an interval with a pitch of 1 mm both in the axial direction and in the circumferential direction, assuming that the region had a width of 20 mm in the axial direction with respect to the central position of the image formation region as its center and was defined by making one turn around the center in the circumferential direction In the next step, each of the electrophotographic photosensitive members was mounted on its optimal modified printer, and the amount of pre-exposure, the charger, and the amount of exposure were set to the values as those in the evaluation of the unevenness of the post-exposure potential. The developing potential was adjusted such that the difference between the charge potential and the developing potential was 200 V. At this time, the difference between the bright potential and the developing potential is 230 V. In this setting, an image having a vertical line pattern with 3 dots and 100 spaces was output to a sheet of normal paper of size A4, and after output to every 1,000 sheets of paper, one sheet of a solid white image for evaluation was output.

In the next step, in the obtained solid white image for evaluation, the number of blue dots present in a region corresponding to one rotation of the electrophotographic photosensitive member was counted. At this time, the number of sheets of paper when a solid white image having 10 or more blue dots was first obtained was defined as the end of the life of the electrophotographic photosensitive member. The drum was extracted. A post-durability difference Df in film thickness was measured, and $Df/D_0$ was defined as a life proportion. The post-durability difference in film thickness indicates a difference between the maximum value and the minimum value when the entire image formation region was measured at an interval with a pitch of 1 mm both in the axial direction and in the circumferential direction while the photosensitive member was being rotated in the circumferential direction. In the present disclosure, the life ratio was ranked according to the following criteria. The criteria for evaluation A to D mean that the effects of the present disclosure are demonstrated.

A: 0.0% to 2.4%
B: 2.5 to 4.9%
C: 5.0 to 7.4%
D: 7.5 to 9.9%
E: 10.0% or higher

TABLE 6

| Production Example No. of photosensitive member | Optimal modified printer B = 0.55 $\theta_{max}\downarrow$ | Unevenness in distribution of post-exposure potential [V] | Rank of unevenness in post-exposure potential | Life ratio [%] | Rank of life ratio |
|---|---|---|---|---|---|
| Example 1 | 65° | 3.6 | A | 8.5 | D |
| Example 2 | 65° | 3.6 | A | 6.0 | C |
| Example 3 | 65° | 3.6 | A | 1.0 | A |
| Example 4 | 45° | 3.6 | A | 4.6 | B |
| Example 5 | 45° | 3.6 | A | 3.0 | B |
| Example 6 | 45° | 3.6 | A | 3.0 | B |
| Example 7 | 25° | 33.0 | C | 4.6 | B |
| Example 8 | 25° | 33.0 | C | 4.6 | B |
| Example 9 | 25° | 33.0 | C | 4.6 | B |
| Example 10 | 25° | 46.0 | D | 4.6 | B |
| Example 11 | 65° | 42.0 | C | 4.6 | B |
| Example 12 | 45° | 42.0 | C | 1.0 | A |
| Example 13 | 55° | 3.6 | A | 8.5 | D |
| Example 14 | 55° | 3.6 | A | 6.0 | C |
| Example 15 | 55° | 3.6 | A | 1.0 | A |
| Example 16 | 45° | 3.6 | A | 8.5 | D |
| Example 17 | 45° | 3.6 | A | 1.0 | A |
| Example 18 | 45° | 3.6 | A | 1.0 | A |
| Example 19 | 25° | 33.0 | C | 4.6 | B |
| Example 20 | 25° | 33.0 | C | 4.6 | B |
| Example 21 | 25° | 33.0 | C | 3.0 | B |
| Example 22 | 25° | 33.0 | C | 1.0 | A |
| Example 23 | 55° | 21.0 | B | 6.0 | C |
| Example 24 | 45° | 18.0 | B | 1.0 | A |
| Example 25 | 55° | 3.6 | A | 7.4 | D |
| Example 26 | 45° | 3.6 | A | 3.0 | B |
| Example 27 | 65° | 24.0 | B | 8.5 | D |
| Example 28 | 65° | 24.0 | B | 6.1 | C |
| Example 29 | 65° | 24.0 | B | 6.0 | C |
| Example 30 | 45° | 24.0 | B | 4.6 | B |
| Example 31 | 45° | 24.0 | B | 3.0 | B |
| Example 32 | 65° | 24.0 | B | 8.5 | D |
| Example 33 | 65° | 24.0 | B | 3.0 | B |
| Example 34 | 65° | 24.0 | B | 1.0 | A |
| Example 35 | 45° | 24.0 | B | 4.6 | B |
| Example 36 | 45° | 31.0 | C | 4.6 | B |
| Example 37 | 65° | 31.0 | C | 8.5 | D |
| Example 38 | 65° | 24.0 | B | 1.0 | A |
| Example 39 | 45° | 24.0 | B | 3.0 | B |
| Example 40 | 45° | 24.0 | B | 4.6 | B |
| Comparative Example 1 | 25° | 106.0 | E | 16.5 | E |
| Comparative Example 2 | 55° | 9.6 | A | 11.6 | E |
| Comparative Example 3 | 25° | 118.0 | E | 12.5 | E |
| Comparative Example 4 | 45° | 8.0 | A | 11.6 | E |
| Comparative Example 5 | 45° | 26.0 | B | 11.6 | E |
| Comparative Example 6 | 55° | 26.0 | B | 11.6 | E |
| Comparative Example 7 | 55° | 26.0 | B | 11.6 | E |
| Comparative Example 8 | 55° | 26.0 | B | 11.6 | E |

As described above, the present disclosure can provide an electrophotographic photosensitive member which enables a reduction in unevenness in distribution of the post-exposure potential of the photosensitive member and a reduction in unevenness in life of the photosensitive member in the axial direction.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-117810, filed Jun. 25, 2019, which is hereby incorporated by reference herein in its entirety.

What is claimed is:

1. An electrophotographic photosensitive member, comprising:

a cylindrical support, a charge generating layer and a charge transport layer in this order;

the charge generating layer comprising titanyl phthalocyanine crystals as a charge generating substance, said titanyl phthalocyanine crystals having a strong peak at a Bragg angle 2θ of 27.2°±0.3° in CuKα characteristic X-ray diffraction, wherein $d_1<d_2<d_3<d_4<d_5$ and $D_1<D_2<D_3<D_4<D_5$ when a region from a central position of an image formation region of the electrophotographic photosensitive member to an end position of the image formation region in an axial direction of the cylindrical support is equally divided into five regions, $d_1$, $d_2$, $d_3$, $d_4$ and $d_5$ are average film thicknesses (nm) of the charge generating layer in the five regions and $D_1$, $D_2$, $D_3$, $D_4$ and $D_5$ are average film thicknesses (μm) of the charge transport layer in the five regions.

2. The electrophotographic photosensitive member according to claim 1, wherein $$1.00<D_2/D_1<1.10$$

$$1.01<D_3/D_1<1.25$$

$$1.05<D_4/D_1<1.45 \text{ and}$$

$$1.10<D_5/D_1<1.70.$$

3. The electrophotographic photosensitive member according to claim 2, wherein $$1.00<D_2/D_1<1.08$$

$$1.02<D_3/D_1<1.13$$

$$1.07<D_4/D_1<1.20 \text{ and}$$

$$1.15<D_5/D_1<1.35.$$

4. The electrophotographic photosensitive member according to claim 1, wherein $$0.8\,A<D_1/d_1<1.2\,A$$

$$0.8\,A<D_2/d_2<1.2\,A$$

$$0.8\,A<D_3/d_3<1.2\,A$$

$$0.8\,A<D_4/d_4<1.2\,A$$

$$0.8\,A<D_5/d_5<1.2\,A$$

where $d_{ave}$ is an average of $d_1$, $d_2$, $d_3$, $d_4$ and $d_5$, $D_{ave}$ is an average of $D_1$, $D_2$, $D_3$, $D_4$ and $D_5$ and $A=D_{ave}/d_{ave}$.

5. The electrophotographic photosensitive member according to claim 1, wherein the film thickness of the charge generating layer is between (d−0.2Δ) and (d+0.2Δ) in all the values of Y where $0\leq Y\leq Y_{max}$ for a value of d=d(Y) calculated from $$d(Y) = d_0 + \Delta(1-\beta\Delta)\frac{Y^2}{Y_{max}^2} + \beta\Delta^2\frac{Y^4}{Y_{max}^4}$$

where Y (mm) is a distance from the central position of the image formation region in the axial direction of the cylindrical support, $Y_{max}$ is a value Y at the end position of the image formation region, β [$nm^{-1}$] is an absorption coefficient of the charge generating layer, and Δ is a difference ($d_6-d_0$) between a film thickness of the charge generating layer do at the central position of the image formation region and a film thickness of the charge generating layer $d_6$ at the end position of the image formation region.

6. The electrophotographic photosensitive member according to claim 1, wherein $$\frac{1-e^{-2\beta d_6}}{1-e^{-2\beta d_6}} \geq 1.2$$

□ where $d_0$ is a film thickness of the charge generating layer at the central position of the image formation region and $d_6$ is a film thickness of the charge generating layer at the end position of the image formation region.

7. The electrophotographic photosensitive member according to claim 1, comprising a conductive layer between the cylindrical support and the charge generating layer, wherein the conductive layer has a film thickness of 5 μm or more, the conductive layer contains a binder resin, and a fine particle of a metal oxide having an average diameter of 100 to 400 nm, and the fine particle of a metal oxide comprises a core material containing titanium oxide, and a containing titanium oxide doped with niobium or tantalum.

8. The electrophotographic photosensitive member according to claim 1, comprising a conductive layer between the cylindrical support and the charge generating layer, wherein the conductive layer has a film thickness of 10 μm or more, and the conductive layer contains a binder resin and a fine particle of a metal oxide.

9. A process cartridge that integrally supports an electrophotographic photosensitive member including a cylindrical support, a charge generating layer and a charge transport layer in this order, and at least one unit selected from the group consisting of a charging unit, a developing unit and a cleaning unit, and is detachably attachable to a body of an electrophotographic apparatus, the charge generating layer co comprising titanyl phthalocyanine crystals as a charge generating substance, said titanyl phthalocyanine crystals having a strong peak at a Bragg angle 2θ of 27.2°±0.3° in CuKα characteristic X-ray diffraction, wherein $d_1<d_2<d_3<d_4<d_5$ and $D_1<D_2<D_3<D_4<D_5$ when a region from a central position of an image formation region of the electrophotographic photosensitive member to an end position of the image formation region in an axial direction of the cylindrical support is equally divided into live regions, $d_1$, $d_2$, $d_3$, $d_4$ and $d_5$ are average film thicknesses (nm) of the charge generating layer in the five regions and $D_1$, $D_2$, $D_3$, $D_4$ and $D_5$ are average film thicknesses (μm) of the charge transport layer in the five regions.

10. An electrophotographic apparatus, comprising:

an electrophotographic photosensitive member including a cylindrical support, a charge generating layer, and a charge transport layer in this order, a charging unit, an exposing unit, a developing unit, and a transferring unit, the charge generating layer comprising titanyl phthalocyanin ne crystals as a charge generating substance, said titanyl phthalocyanine crystals having a strong peak at a Bragg angle 2θ of 27.2°±0.3° in CuKα characteristic X-ray diffraction, wherein $d_1<d_2<d_3<d_4<d_5$ and $D_1<D_2<D_3<D_4<D_5$ when a region from a central position of art image formation region of the electrophotographic photosensitive member to an end position of the image formation region in an axial direction of the cylindrical support is equally divided into five regions, $d_1$, $d_2$, $d_3$, $d_4$ and $d_5$ are average film thicknesses (nm) of the charge generating layer in the five regions and $D_1$, $D_2$, $D_3$, $D_4$ and $D_5$ are average film thicknesses (μm) of the charge transport layer in the five regions.

11. An electrophotographic photosensitive member, comprising:

a cylindrical support, a charge generating layer and a charge transport layer in this order;

the charge generating layer containing hydroxygallium phthalocyanine crystals as a charge generating substance, said hydroxygallium phthalocyanine crystals having strong peaks at Bragg angles 2θ of 7.4°±0.3 and 28.2±0.3° in CuKα characteristic X-ray diffraction, wherein $d_1<d_2<d_3<d_4<d_5$ and $D_1<D_2<D_3<D_4<D_5$ when a region from a central position of an image formation region of the electrophotographic photosensitive member to an end position of the image formation region in an axial direction of the cylindrical support is equally divided into five regions, $d_1$, $d_2$, $d_3$, $d_4$ and $d_5$ are average film thicknesses (nm) of the charge generating layer in the five regions, and $D_1$, $D_2$, $D_3$, $D_4$ and $D_5$ are average film thicknesses (μm) of the charge transport layer in the five regions.

12. The electrophotographic photosensitive member according to claim 11, wherein $$0.8\,A<D_1/d_1<1.2\,A$$

$$0.8\,A<D_2/d_2<1.2\,A$$

$$0.8\,A<D_3/d_3<1.2\,A$$

$$0.8\,A<D_4/d_4<1.2\,A \text{ and}$$

$$0.8\,A<D_5/d_5<1.2\,A$$

where $d_{ave}$ is an average of $d_1$, $d_2$, $d_3$, $d_4$ and $d_5$, $D_{ave}$ is an average of $D_1$, $D_2$, $D_3$, $D_4$ and $D_5$, and $A=D_{ave}/d_{ave}$.

13. The electrophotographic photosensitive member according to claim 11, wherein $$\frac{1-e^{-2\beta d_0}}{1-e^{-2\beta d_0}} \geq 1.2$$

where $d_0$ is a film thickness of the charge generating layer at the central position of the image formation region and $d_6$ is a film thickness of the charge generating layer at the end position of the image formation region.

14. The electrophotographic photosensitive member according to claim 11, comprising a conductive layer between the cylindrical support and the charge generating layer, wherein the conductive layer has a film thickness of 5 μm or more, the conductive layer contains a binder resin, and a fine particle of a metal oxide having an average diameter of 100 to 400 nm, and the fine particle of a metal oxide comprises a core material containing titanium oxide, and a coating layer containing titanium oxide doped with niobium or tantalum.

15. The electrophotographic photosensitive member according to claim 11, comprising a conductive layer between the cylindrical support and the charge generating layer, wherein the conductive layer has a film thickness of 10 μm or more, and the conductive layer contains a binder resin and a fine particle of a metal oxide.

16. All electrophotographic photosensitive member, comprising:

a. cylindrical support, a charge generating layer and a charge transport layer in this order, wherein $d_1<d_2<d_3<d_4<d_5$ and $D_1<<D_2<D_3<D_4<D_5$ when a region from a central position of art image formation region of the electrophotographic photosensitive, member to an end position of the image formation region in an axial direction of the cylindrical support is equally divided into five regions, $d_1$, $d_2$, $d_3$, $d_4$ and $d_5$ are average film thicknesses (nm) of the charge generating, layer in the five regions, and $D_1$, $D_2$, $D_3$, $D_4$ and $D_5$ are average film thicknesses (μm) of the charge transport layer in the five regions, and the film thickness of the charge generating layer is between (d−0.2Δ) and (d−0.2Δ) in all the values of Y where $0 \leq Y \leq Y_{max}$ for a value of d=d(Y) calculated from $$d(Y) = d_0 + \Delta(1-\beta\Delta)\frac{Y^2}{Y_{max}^2} + \beta\Delta^2\frac{Y^4}{Y_{max}^4}$$

where Y (mm) is a distance from the central position of the image formation region in the axial direction of the cylindrical support, $Y_{max}$ is a value Y at the end position of the image formation region, β [$nm^{-1}$] is an absorption coefficient of the charge generating layer, and Δ is a difference ($d_6-d_0$) between a film thickness of the charge generating layer $d_0$ at the central position of the image formation region and a film thickness of the charge generating layer $d_6$ at the end position of the image formation region.

17. The electrophotographic photosensitive member according to claim 16, wherein $$0.8\,A<D_1/d_1<1.2\,A$$

$$0.8\,A<D_2/d_2<1.2\,A$$

$$0.8\,A<D_3/d_3<1.2\,A$$

$$0.8\,A<D_4/d_4<1.2\,A \text{ and}$$

$$0.8\,A<D_5/d_5<1.2\,A$$

where $d_{ave}$ is an average of $d_1$, $d_2$, $d_3$, $d_4$ and $d_5$, $D_{ave}$ is an average of $D_1$, $D_2$, $D_3$, $D_4$ and $D_5$, and $A=D_{ave}/d_{ave}$.

18. The electrophotographic photosensitive member according to claim 16, wherein $$\frac{1-e^{-2\beta d_0}}{1-e^{-2\beta d_0}} \geq 1.2$$

where $d_0$ is a film thickness of the charge generating layer at the central position of the image formation region and $d_6$ is a film thickness of the charge generating layer at the end position of the image formation region.

19. The electrophotographic photosensitive member according to claim 16, comprising a conductive layer between the cylindrical support and the charge generating layer, wherein the conductive layer has a film thickness of 5 μm or more, and contains a binder resin and a fine particle of a metal oxide having an average diameter of 100 to 400 nm, and the fine particle of metal oxide comprises a core material containing titanium oxide, and a coating layer containing titanium oxide doped with niobium or tantalum.

20. The electrophotographic photosensitive member according to claim 16, comprising a conductive layer between the cylindrical support and the charge generating layer, wherein the conductive layer has a film thickness of 10 μm or more, and the conductive layer contains a binder resin and a fine particle of a metal oxide.

* * * * *